United States Patent [19]

Oishi et al.

[11] 3,960,570

[45] June 1, 1976

[54] COLOR PHOTOGRAPHIC SILVER HALIDE LIGHT-SENSITIVE MATERIALS

[75] Inventors: Yasushi Oishi; Reiichi Ohi; Yoshio Kosuge, all of Minami-ashigara, Japan

[73] Assignee: Fuji Photo Film Co., Ltd., Minami-ashigara, Japan

[22] Filed: Feb. 11, 1974

[21] Appl. No.: 441,522

[30] Foreign Application Priority Data

Feb. 9, 1973 Japan ..... 48-16255

[52] U.S. Cl. ..... 96/100; 96/22; 96/55 ; 96/56; 96/56.2; 96/56.3; 96/56.4; 96/56.5; 96/56.6; 96/74

[51] Int. Cl.[2] ..... G03C 1/40

[58] Field of Search ..... 96/100, 56, 55

[56] References Cited

UNITED STATES PATENTS

| | | | |
|---|---|---|---|
| 2,336,327 | 12/1943 | Weissberger et al. | 96/56 |
| 2,701,197 | 2/1955 | Thirtle et al. | 96/56 |
| 2,728,659 | 12/1955 | Loria et al. | 96/56 |
| 3,265,506 | 8/1966 | Weissberger et al. | 96/100 |
| 3,700,453 | 10/1972 | Knechel | 96/56 |

*Primary Examiner*—J. Travis Brown

*Attorney, Agent, or Firm*—Sughrue, Rothwell, Mion, Zinn & Macpeak

[57] ABSTRACT

A color photographic silver halide light-sensitive material containing a 2-equivalent alpha-acylacetoamide yellow dye-forming coupler and a monoalkylhydroquinone.

17 Claims, No Drawings

COLOR PHOTOGRAPHIC SILVER HALIDE LIGHT-SENSITIVE MATERIALS

BACKGROUND OF THE INVENTION

1. Field of the Invention

The present invention relates to a color photographic light-sensitive material, and more particularly relates to a color photographic silver halide light-sensitive material capable of forming yellow color images having an increased image density and a reduced fog density.

2. Description of the Prior Art

The step or steps of forming cyan, magneta and yellow dyes by coupling dye-forming couplers with the oxidation products of aromatic primary amine color developing agents which are produced by the reaction with exposed silver halide particles have generally been used for the formation of color photographic images.

As the yellow dye-forming couplers capable of forming yellow color images having an absorption in the wave length of about 400 to 500 m$\mu$, $\beta$-ketoaceto acetic acid esters, $\beta$-diketones, N,N'-malondiamides and $\alpha$-acylacetoamides are known. Of these couplers, the acylacetoamides have been widely used as yellow dye-forming couplers in the art since they have better characteristics.

Further, $\alpha$-acylacetoamides of which an active hydrogen atom in the $\alpha$-position is substituted with a coupling-off group have been proposed.

The $\alpha$-acylacetoamides (substituted in the $\alpha$-position) can reduce an amount of silver halide added to the light-sensitive material because they require only two equivalents of silver halide as an oxidizing agent for forming a molecule of dye (therefore, they are generally designated "two equivalent couplers"). In addition, image sharpness is increased because these couplers reduce light-scattering in the light-sensitive material.

Further, since the dye is formed in the color developing steps using $\alpha$-acylamide type couplers (substituted in the $\alpha$-position), it is unnecessary to use a specific oxidizing agent after the color development and the color developing steps are easily simplified.

However, this coupler has the defect that increased yellow fog is often generated, and this defect is an obstacle in using the couplers in light-sensitive materials.

In order to remove this defect, the use of a compound capable of forming a slightly soluble silver salt such as an active sulfur compound, the use of an insufficiently spectrally sensitized silver halide emulsion, the use of weak developing conditions, and the use of colorless competing couplers have been proposed. However, these methods are not sufficient because the sensitivity of the light-sensitive material is adversely reduced, the shelf life of the light-sensitive material is shortened, the developing time is increased and unstable color dye images are formed.

In order to prevent color fog, it is well known to carry out color development in the presence of a reducing compound, and many useful reducing compounds are proposed. For example, dialkylhydroquinones are disclosed in U.S. Pat. Nos. 2,336,327, 2,360,290, 2,403,721, 2,728,659, 2,732,300 and 2,735,765, hydroquinones substituted with an aryl group are disclosed in U.S. Pat. No. 2,418,618, hydroquinones substituted with a sulfo group are disclosed in U.S. Pat. No. 2,675,314, high molecular compounds having a hydroquinone residue are disclosed in U.S. Pat. No. 2,360,290, catechol derivatives are disclosed in French Pat. No. 885,982, aminophenol derivatives are disclosed in U.S. Pat. Nos. 2,336,327, 2,403,721 and British Pat. No. 1,133,500, gallic acid derivatives are disclosed in Japanese Pat. Publication No. 13,496/68 and U.S. Pat. No. 3,457,079, and ascorbic acids are disclosed in U.S. Pat. Nos. 2,360,290 and 2,384,658. However, it has now been determined by our experiments that none of these compounds remove or control the color fog to a sufficient degree.

Moreover, when a silver halide emulsion layer of the so-called multi-layer type light-sensitive material, which is composed of a support having coated thereon light-sensitive silver halide emulsion layers sensitive to different spectral regions and containing one of the couplers, the oxidation product in one layer can diffuse into another layer, whereby the relation between the spectral sensitivity of the layer and the dye formed therein is destroyed. Therefore, the phenomenon is not preferred for the color reproduction because of color mixing. Previously, proposals of means to correct the mixing of couplers have been made, but these means are not suitable since they have little effect on the couplers or they have an adverse influence on the stability of color images.

An object of this invention is to provide a color photographic material having high sensitivity and capable of forming higher image density without causing color fog on color development.

A second object of the invention is to provide a color photographic material which is stable for a long period of time between the preparation thereof and the development thereof.

A third object of the invention is to provide a color photographic light-sensitive material capable of forming sharp color photographs with stable color images and with better reproduction of white color.

A fourth object of the invention is to provide a color photographic light-sensitive material capable of being rapidly developed without decreasing the image qualities.

These and other objects of the invention will be apparent from the following disclosure.

SUMMARY OF THE INVENTION

The objects of the invention can be accomplished by a silver halide color photographic light-sensitive material containing a two equivalent $\alpha$-acylacetoamide yellow dye-forming coupler and a monoalkylhydroquinone.

DETAILED DESCRIPTION OF THE INVENTION

According to the present invention, the color fog arising due to two equivalent yellow dye-forming couplers can be advantageously controlled by using a monoalkylhydroquinone. That better results are obtained is exceedingly surprising since most of the reducing compounds and compounds similar thereto in chemical structure which have been proposed for conventional color photographic light-sensitive materials do not provide good results in achieving the above objects of the invention. In other words, one skilled in the art would not expect that the above objects would be attained by using a monoalkylhydroquinone. Since color fog due to only the two equivalent yellow dye-forming couplers can be advantageously controlled with the monoalkylhydroquinone, it is believed that such color fog is quite different from the color fog due to conventional four equivalent couplers.

It is known to apply a monoalkylhydroquinone to a color photographic light-sensitive material. For example, a mono(linear chain type alkyl)hydroquinone is disclosed in U.S. Pat. No. 2,728,659 and a mono-(branched chain type alkyl)hydroquinone is disclosed in British Pat. Nos. 557,750 and 557,802. However, these hydroquinones are used in combination with a four equivalent yellow dye-forming coupler and, as described above, the color fog due to the four equivalent couplers is different from that due to the two equivalent couplers, and thus the prior art would not teach the unique and surprising effects obtained where a monoalkylhydroquinone and a two-equivalent coupler are used in combination.

The monoalkylhydroquinone of the invention can be characterized as a hydroquinone in which the only substituent of the benzene ring thereof is an alkyl group, which can be further substituted.

The monoalkylhydroquinone of the invention includes compounds represented by the following formula (I), (I)

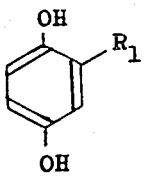

wherein $R_1$ is a substituted or unsubstituted alkyl group.

Suitable alkyl groups represented by $R_1$ in the formula (I) can include alkyl groups having from 4 to about 25 carbon atoms such as a linear chain alkyl group (e.g. n-butyl, n-amyl, n-hexyl, n-heptyl, n-octyl, n-nonyl, n-decyl, n-dodecyl, n-pentadecyl, n-octadecyl), and a branched chain alkyl group (e.g. isobutyl), tert-butyl, isoamyl, tert-amyl, 1-methylpentyl, 2-methylpentyl, 1,1-dimethylbutyl, 1-methylhexyl, 2-methylhexyl, 1,1-dimethylhexyl, 2-ethylhexyl, tert-octyl, α-methylheptadecyl). It is desirable that the molecular weight of the alkyl group including substituents be more than about 55. The upper limit of the molecular weight of the substituted alkyl group is not limited and can range up to about 600. Examples of substituents for the alkyl group are a halogen atom (e.g., fluorine, bromine, chlorine, etc.), a hydroxyl group, an alkoxy group (e.g., methoxy, ethoxy, ethoxyethoxy, hexyloxy, dodecyloxy, etc.), an aryloxy group (e.g., phenoxy, p-tert-butylphenoxy, etc.), an aryl group (e.g. phenyl, tolyl, p-tridecanamidephhenyl, naphthyl, etc.), an amino group (e.g., ethylamino, dodecylamino, diethylamino, N-methyl-N-dodecylamino, anilino, toluidino, phenethylamino, etc.), an acylamino group (e.g., formamido, acetamido, pivaloylamido, lauroylamido, stearoylamido, benzoylamido, etc.), an imide group, a carboxy group, an alkoxycarbonyl group (e.g., ethoxycarbonyl, dodecyloxycarbonyl, etc.), a carbamoyl group (e.g., tert-butylcarbamyl, di-ethylcarbamyl, isooctylcarbamyl, tolylcarbamyl, etc.) or a sulfonamide group. These substituents can be further substituted.

The monoalkylhydroquinone of the invention also includes precursors thereof. Such precursors are compounds capable of releasing monoalkylhydroquinone by hydrolysis in an aqueous alkaline solution such as a developing solution. Illustrative examples of precursors are the acyl compounds represented by the formulae (Ia), (Ib) and (Ic).

(Ia)

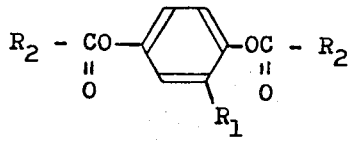

(Ib)

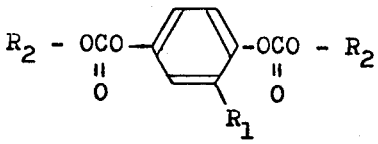

(Ic)

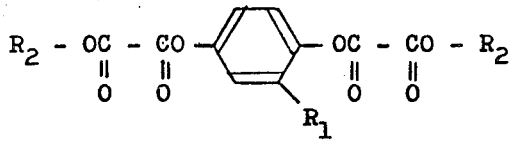

wherein $R_1$ is the same as defined above and $R_2$ is an alkyl group, e.g., an alkyl group having from 1 to about 15 carbon atoms.

The typical examples of monoalkylhydroquinones which can be suitably used in the invention are shown below.

(a)

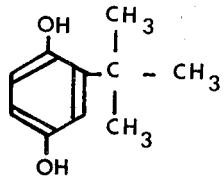

(b)

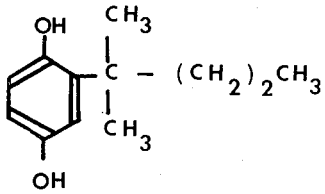

(c)

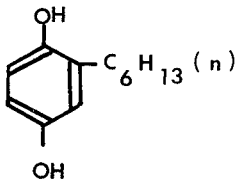

(d)

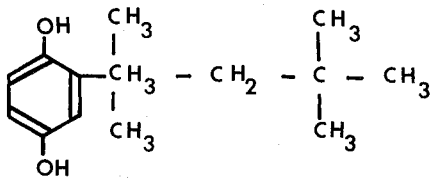

(e)

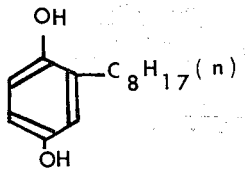

(f)

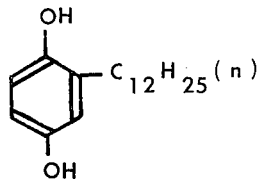

(g)

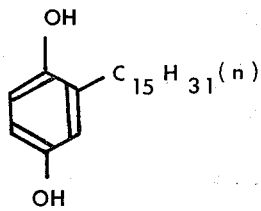

(h)

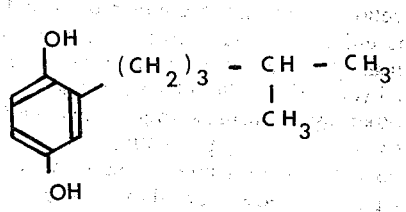

(i)

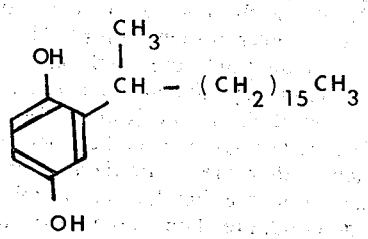

(j)

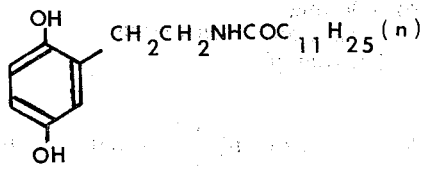

(k)

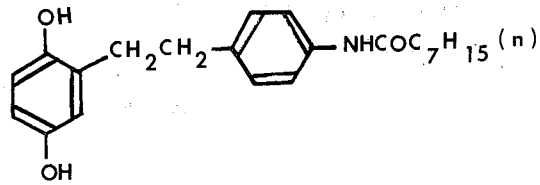

These monoalkylhydroquinones can be synthesized according to the processes disclosed in U.S. Pat. Nos. 2,722,556, 3,062,884 and 3,236,893, Japanese Pat.

application laid open to public inspection 2,128/71, and J. Org. Chem., Vol. 22, Pages 772 to 774.

A two equivalent α-acylactoamide yellow dye-forming coupler as used in the invention is a α-acylacetoamide compound of which one hydrogen atom in the active methylene group at the α-position is replaced by a coupling-off group, while the four equivalent yellow dye-forming coupler is α-acylacetoamide compound of which the hydrogen atom is not replaced by a coupling-off group. A coupling-off group is a group which can be split off as an anion by the coupling reaction of the coupler with the oxidation products of aromatic primary color developing agents.

The two equivalent α-acylacetoamide yellow dye-forming coupler used in the invention includes compounds represented by the formula (II).

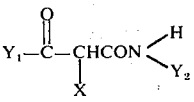

(II)

wherein $Y_1$ is an aliphatic group, an aromatic group or a heterocyclic group, $Y_2$ is an aromatic group or a heterocyclic group, and X is a coupling-off group.

In the formula (II), an aliphatic group shown by $Y_1$ includes a substituted or unsubstituted alkyl group which may exist as a chain or in the form of a ring. Suitable substitutents for the alkyl group are an alkenyl group, an aryl group, an alkoxy group, an aryloxy group, an aryl group, an alkoxy group, an aryloxy group, an acyl group, an amino group, a carboxy group, an acylamino group, a carbamoyl group, an imide group, an alkoxycarbonyl group, an acyloxy group, a sulfo group, a sulfonyl group, a sulfonamide group and a sulfamoyl group, which can be further substituted.

Typical examples of aliphatic groups useful as the $Y_1$ substituent are methyl, ethyl, propyl, isopropyl, butyl, isobutyl, tert-butyl, amyl, isoamyl, tert-amyl, hexyl, 1-methylpentyl, 2-methylpentyl, neopentyl, 1-dimethylbutyl, heptyl, 1-methylhexyl, 2-methylhexyl, 3-methylhexyl, 5-methylhexyl, 1,1-dimethylhexyl, octyl, 2-ethylhexyl, 1,1-diethylhexyl, nonyl, isononyl, decyl, undecyl, dodecyl, tetradecyl, hexadecyl, octadecyl, 1,1-dimethylnonyldecyl, 1,1-diamylhexyl, 1-methyl-1-nonyldecyl, cyclopropyl, cyclobutyl, cyclopentyl, cyclohexyl, benzyl, phenethyl, allyl, oleyl, 7,7-dimethylnorbornyl, 1-methylcyclohexyl, 2-methoxyisopropyl, 2-benzylisopropyl, 2-phenoxyisopropyl, 2-p-tert-butylphenoxy-isopropyl, 2-naphthoxyisopropyl cinnamyl, α-aminoisopropyl, α-(N,N-diethylamino)isopropyl, α-(succinic imide)isopropyl, α-(phthalic imide)isopropyl, α-(acetylamino)isopropyl and α-(benzenesulfonamido)isopropyl.

The aromatic groups represented by $Y_1$ and $Y_2$ include both a substituted or unsubstituted phenyl group. As the substituents for the phenyl group, there are monovalent substituents such as a halogen atom, a nitro group, a cyano group, a thiocyano group, a hydroxy group, an alkoxy group, an aryloxy group, an acyloxy group, an alkyl group, an alkenyl group, an aryl group, an amino group, a carboxy group, an acyl group, an alkoxycarbonyl group, an aryloxycarbonyl group, a carbamoyl group, an acylamino group, an imide group, a sulfo group, an alkylsulfonyl group, an arylsulfonyl group, an alkoxysulfonyl group, an aryloxysulfonyl group, a sulfamoyl group, a sulfonamide group, or a ureido group, and a divalent group capable of forming a fused ring with the phenyl group. Suitable such groups formed by the fusing of a divalent group as a ring with the phenyl group are a naphthyl group, a quinolyl group, an isoquinolyl group, a cumaronyl group, a cunaranyl group and a tetrahydronaphthyl group. The monovalent and divalent groups can be further substituted.

The heterocyclic groups represented by $Y_1$ and $Y_2$ can be connected through the carbon atom forming the ring to the carbon atom of carbonyl group for the acyl group and the nitrogen atom of the amide group in the $\alpha$-acylacetoamide. As such heterocyclic groups, there are thiophenols, furans, pyrans, chromenes, pyrroles, pyrazoles, pyridines, pyrazines, pyrimidines, pyridazines, indolidines, thiazoles, imidazoles, oxazoles and oxazines. These heterocyclic groups can be substituted with a halogen atom, a nitro group, a cyano group, a thiocyano group, a hydroxy group, an alkoxy group, an aryloxy group, an acyloxy group, an alkyl group, an alkenyl group, an aryl group, an amino group, a carboxy group, an acyl group, an alkoxycarbonyl group, an aryloxycarbonyl group, a carbamoyl group, an acylamino group, an amide group, a sulfo group, an alkylsulfonyl group, an arylsulfonyl group, an alkoxysulfonyl group, an aryloxysulfonyl group, a sulfamoyl group, a sulfonamide group, a ureido group and a thioureido group.

The coupling-off group shown by X in the formula (II) is a group capable of being split off as an anion ($X^-$) from the $\alpha$-position of the acylacetoamide by the oxidation product of aromatic primary amino developing agent as described above, and the acid residue derived from the acid XH. Useful coupling-off groups in the invention can be selected from the groups derived from the acids having a pKa of about 2 to about 11, preferably 3 to 10, as measured in water at 25°C. An acylacetoamide type coupler into which an acid residue derived from an acid having a pKa outside the above range is introduced is unstable, results in a comparatively increased color fog, and is reduced in coupling activity in the light-sensitive material after long storage, and therefore often better results are not obtained even if used together with the monoalkylhydroquinone.

The two equivalent acylacetoamide yellow dye-forming couplers advantageously used in the invention have a coupling-off group selected from the group consisting of a fluorine atom, an acyloxy group, an aryloxy group, an arylthio group, a heterocyclic oxy group, a heterocyclic thio group, a cyclic diacylamino group and a cyclic acylsulfonylamino group.

The pKa values in water at 25°C of typical acids forming coupling-off groups are shown in the following table.

| Acid Forming Coupling-Off Group | pKa |
|---|---|
| F—H | 3.2 |
| $CH_3\overset{O}{\overset{\|\|}{C}}O—H$ | 4.8 |
| 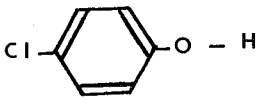 | 9.4 |

-continued

| Acid Forming Coupling-Off Group | pKa |
|---|---|
| 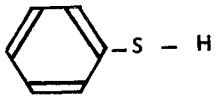 | 6.5 |
| 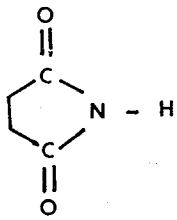 | 9.6 |
| 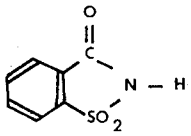 | 2.4 |

It is desirable that the two equivalent acylacetoamide yellow dye-forming coupler used in the invention be non-diffusible. The term "non-diffusible" means, as is usually known in the art, that the coupler is ballasted in a hydrophilic colloid layer, and does not migrate to the other layers during storage or leach into the processing solutions during processing. In order to render the coupler non-diffusible, at least one hydrophobic group having not less than about 8 carbon atoms, such as alkyl group or alkylaryl group, is introduced into the molecule of the coupler in a conventional manner. Many examples of such hydrophobic groups are known in the art and can be used in the invention. In the invention, the hydrophobic group can be introduced into at least one of $Y_1$, $Y_2$ and X in the formula (II).

The ballast group may be bonded to the coupler moiety, either directly or via an amino bond, an ether bond, a thioether bond, a carbonamide bond, a sulfonamide bond, urea bond, an ester bond, an imide bond, a carbonyl bond or a sulfonyl bond.

Examples of such ballast groups are illustrated in the following.

i. Alkyl and alkenyl groups:

For example, $$-CH_2CH\begin{matrix}C_2H_5\\C_2H_5\end{matrix},\ -C_{12}H_{25},\ -C_{16}H_{33},\ \text{or}\ -C_{17}H_{33}$$

ii. Alkoxyalkyl groups:

For example, $$-(CH_2)_3O(CH_2)_7CH_3\ \text{or}\ -(CH_2)_3OCH_2-\underset{\underset{C_2H_5}{|}}{CH}-(CH_2)_8CH_3$$

as described in Japanese Patent Publication 27563/'64 iii. Alkylaryl groups:

For example,

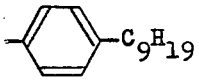

or

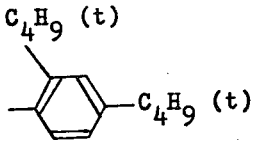

iv. Alkylaryloxyalkyl groups:
For example,

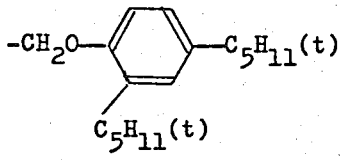

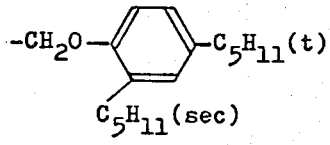

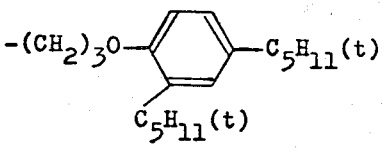

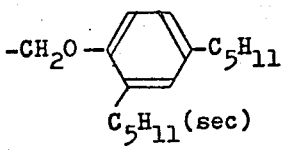

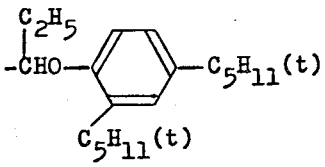

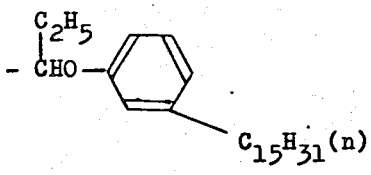

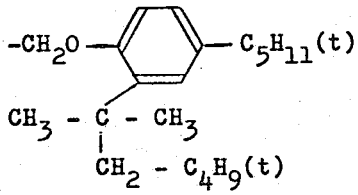

or

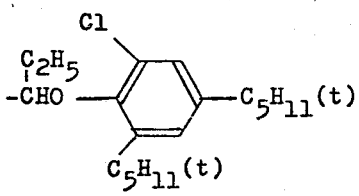

v. Acylamidoalkyl groups:
For example,

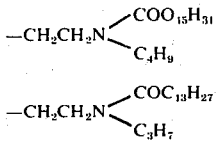

or

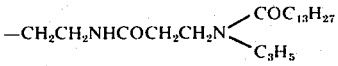

as described in U.S. Pat. Nos. 3,337,344 and 3,418,129.

vi. Alkoxyaryl and aryloxyaryl groups:

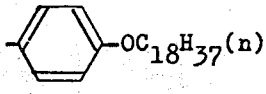

or

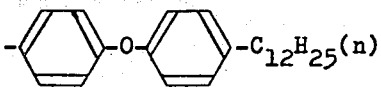

vii. Residual groups containing a long chain aliphatic group, such as an alkyl and/or an alkenyl group, together with a carboxyl or a sulfo group:
For example,

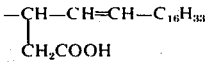

or

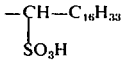

The yellow dye-forming couplers represented by the formula (II) include compounds comprising two coupler residues connected to each other through a $Y_1$, $Y_2$ or X substituent. In these cases, the yellow dye-forming couplers are represented by the formula,

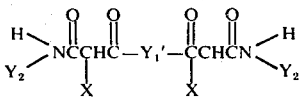

(IIa)

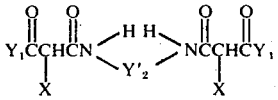

(IIb)

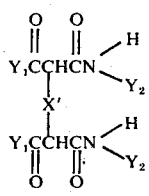

(IIc)

wherein $Y'_1$, $Y'_2$ and $X'$ each is a divalent group corresponding to the monovalent $Y_1$, $Y_2$ and X groups of the formula (II), respectively.

In the formula (II), a two equivalent yellow dye-forming coupler in which $Y_1$ is an alkyl group having a tertiary carbon atom, especially a tert-butyl group is preferred. A two equivalent coupler in which $Y_1$ is a phenyl group or a phenyl group substituted with a halogen atom, an amino group, an acylamino group, an alkoxy group or an aryloxy group is also preferred. Further, a two equivalent yellow dye-forming coupler in which $Y_2$ is a phenyl group or a phenyl group substituted with a halogen atom, a trifluoromethyl group, an amino group, an acylamino group, a sulfonamide group, an ureido group, an alkyl group, an alkoxy group, an aryloxy group, a carboxy group, an alkoxycarbonyl group, a carbamoyl group, a sulfo group, a sulfamoyl group or an imide group is preferred, and a coupler represented by the formula (III) is especially preferred,

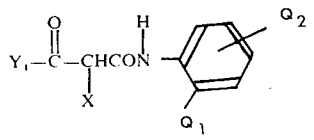

(III)

wherein $Q_1$ is a halogen atom, an alkoxy group, an aryloxy group, a dialkylamino group or an alkyl group, and $Q_2$ is attached to the 4- or the 5-position of anilide nucleus and is a halogen atom, a trifluoromethyl group, an acylamino group, a sulfonamide group, a ureido group, an alkyl group, an alkoxy group, an aryloxy group, a carboxy group, an alkoxycarbonyl group, a carbamoyl group, a sulfo group, a sulfamoyl group or an imide group, and $Y_1$ and X are as defined above.

Typical examples of the yellow dye-forming couplers which can be used in the invention are shown as follows:

(1)

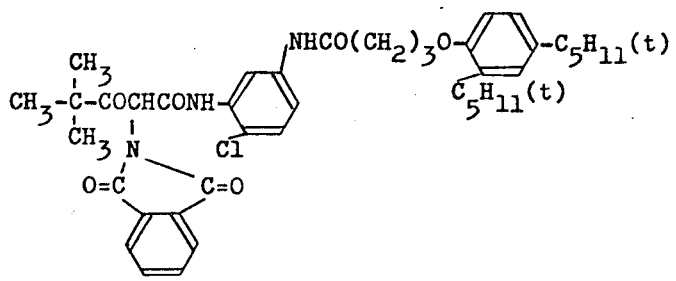

(2)

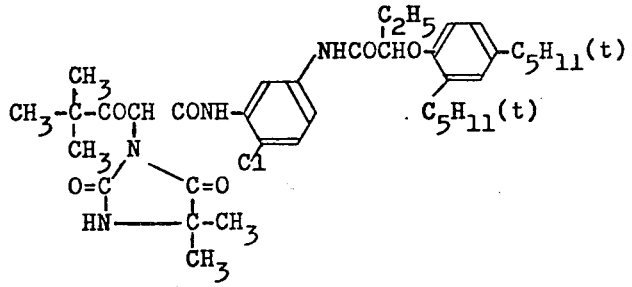

(3)

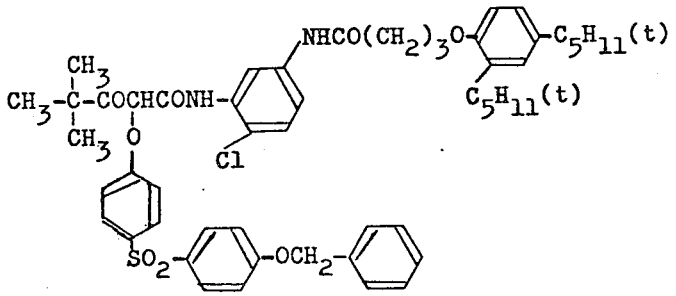

(4)

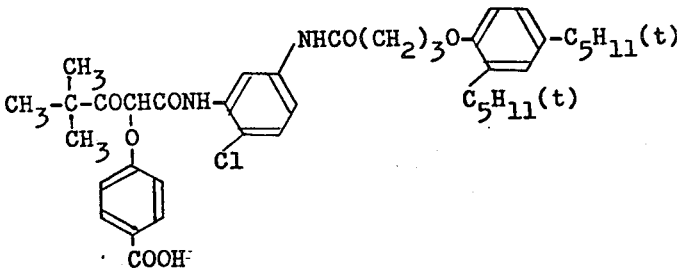

(5)
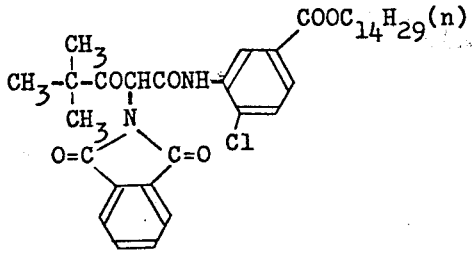
(6)
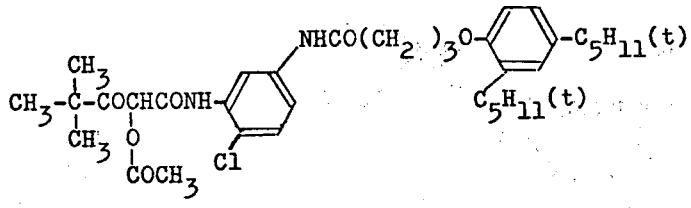
(7)
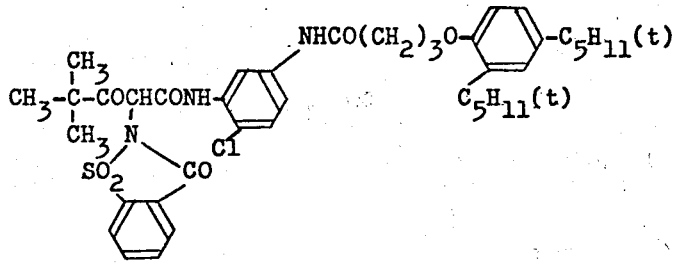
(8)
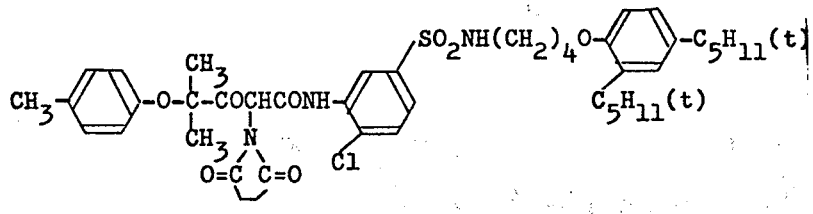
(9)
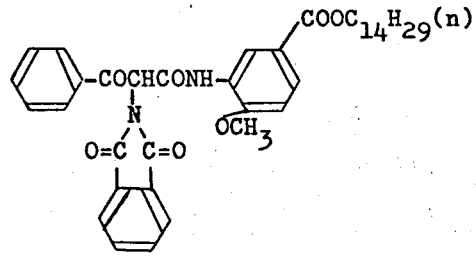
(10)
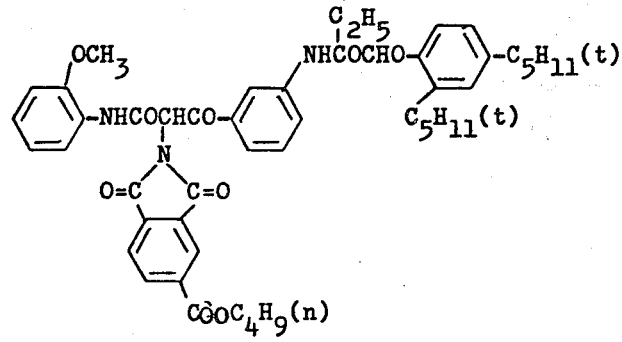

(11)
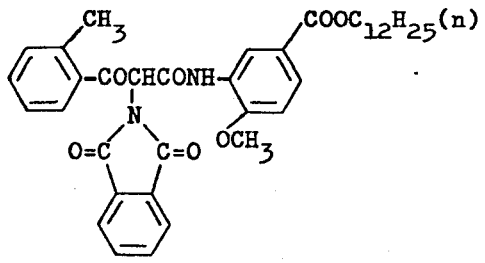
(12)
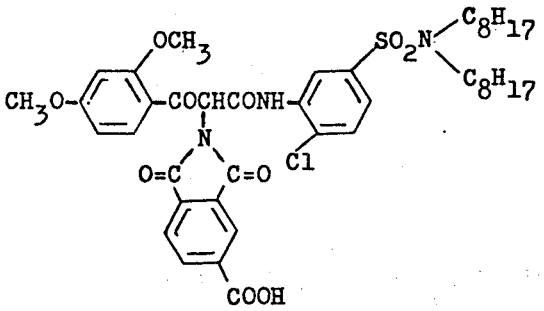
(13)
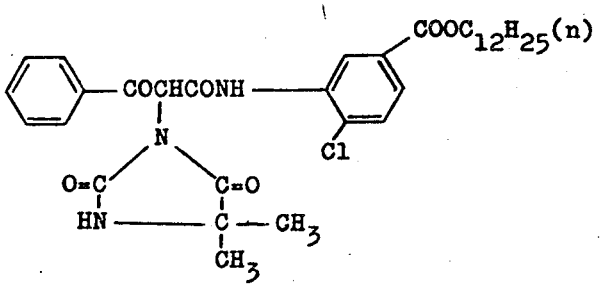
(14)
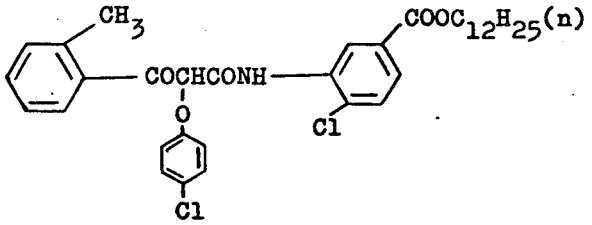
(15)
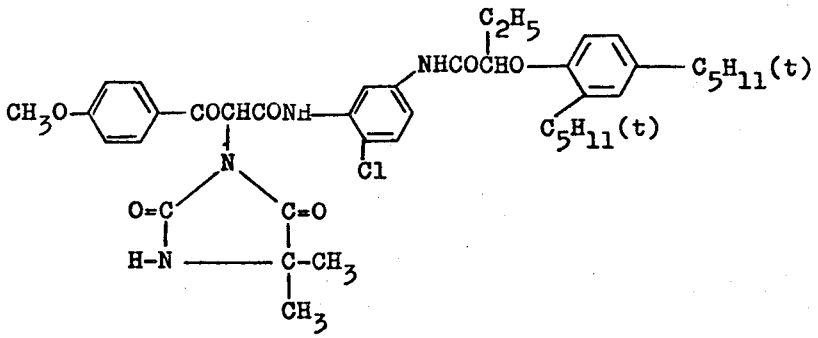

(16)
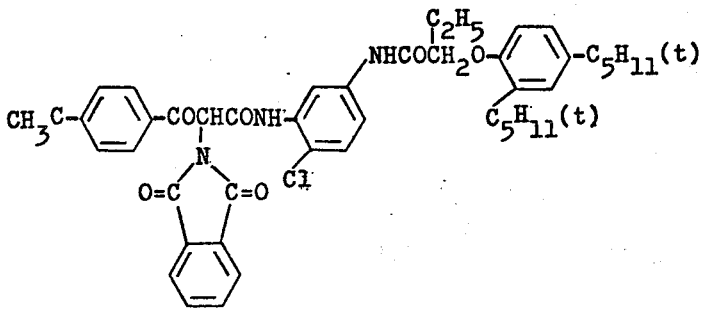
(17)
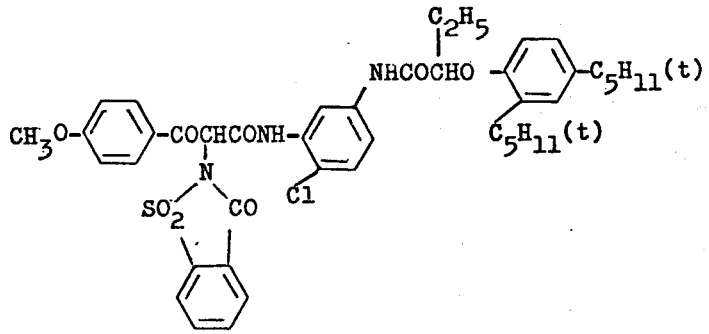
(18)
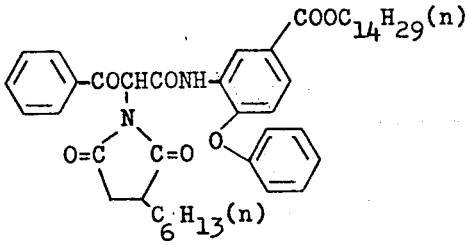
(20)
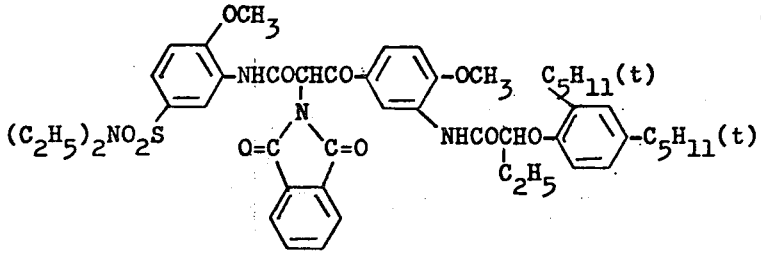
(21)
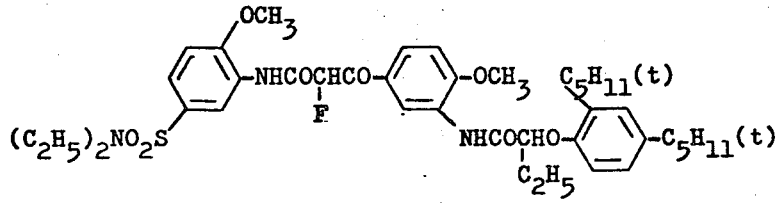
(22)
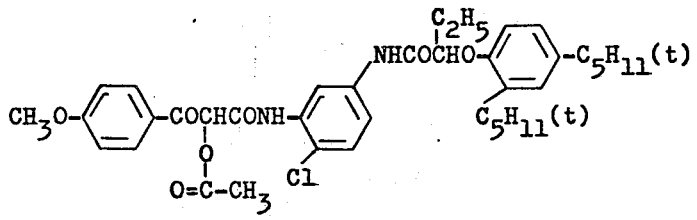

(23)
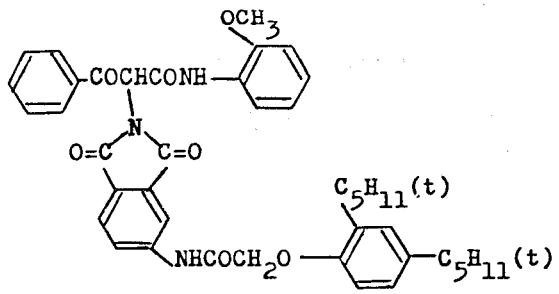
(24)
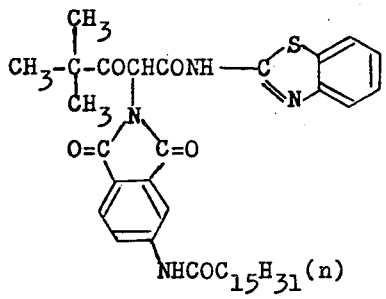
(25)
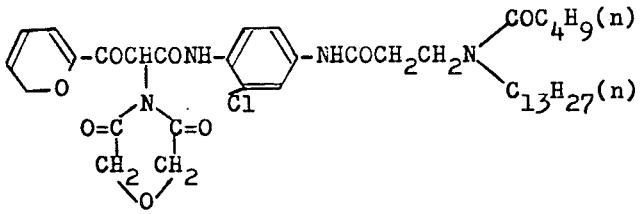
(26)
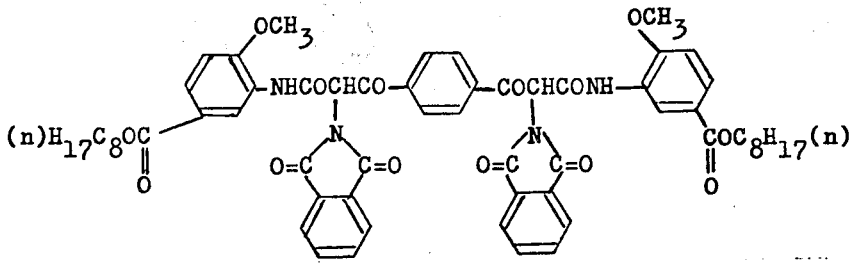
(27)
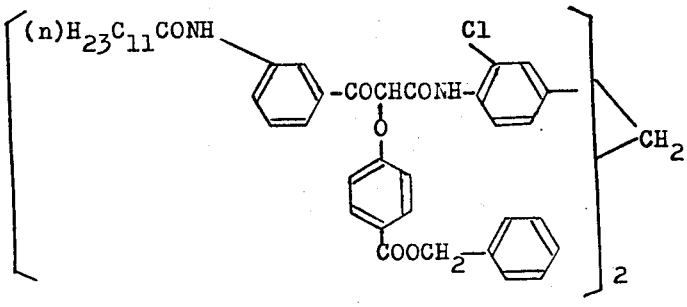

(28)
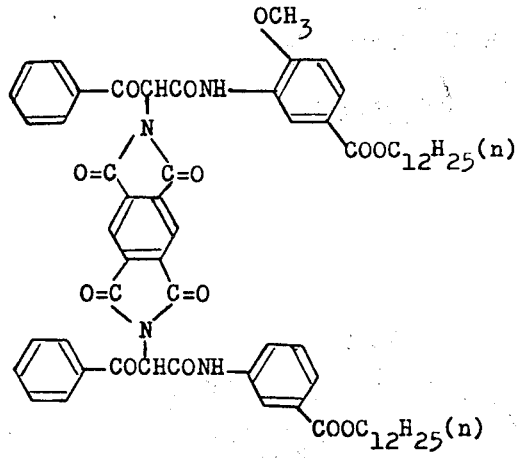
(29)
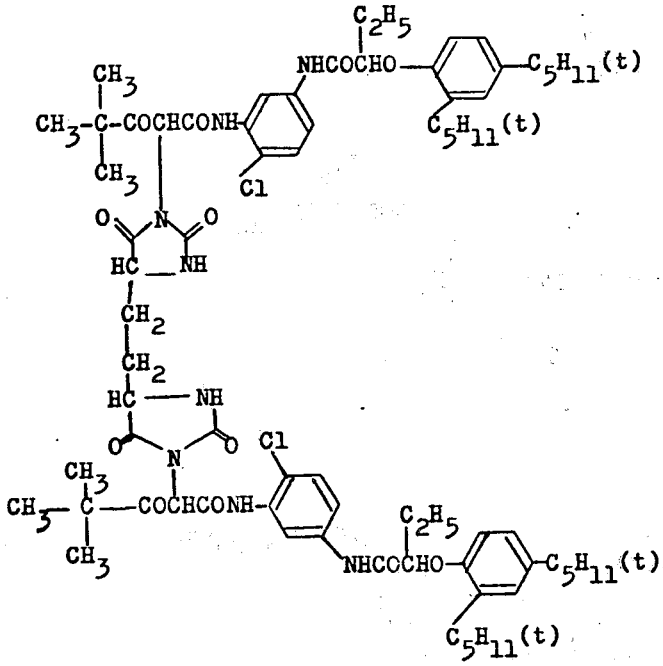
(30)
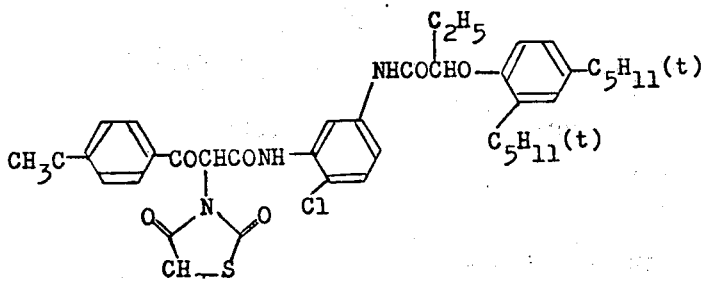
(31)
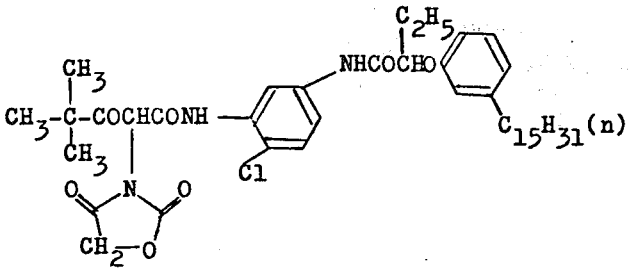

(32)
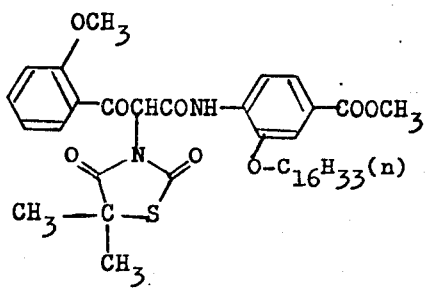
(33)
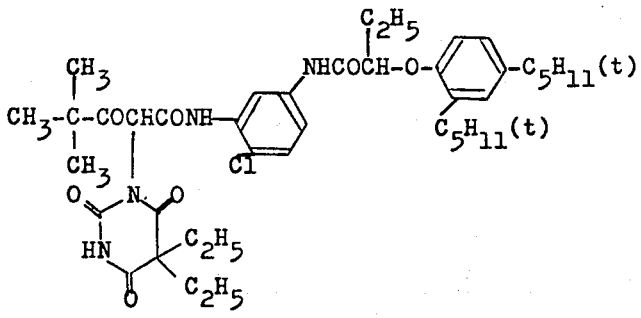
(34)
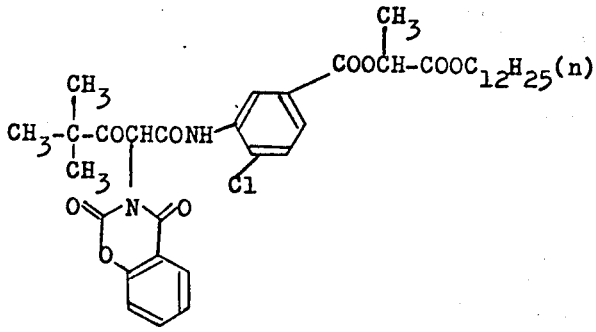
(35)
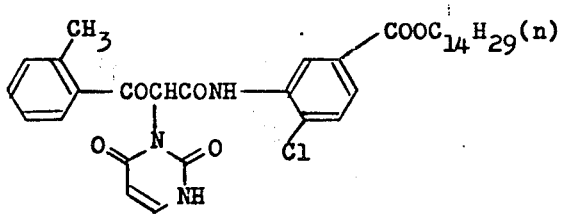
(36)
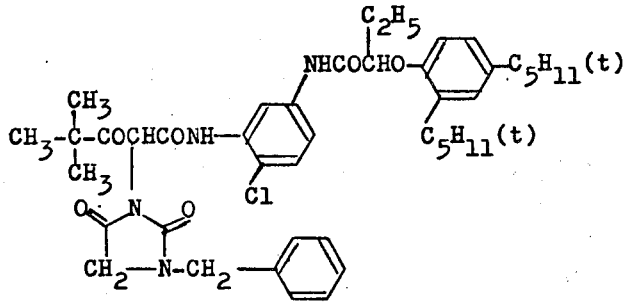
(37)
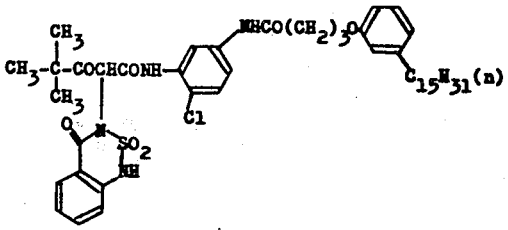

(38)
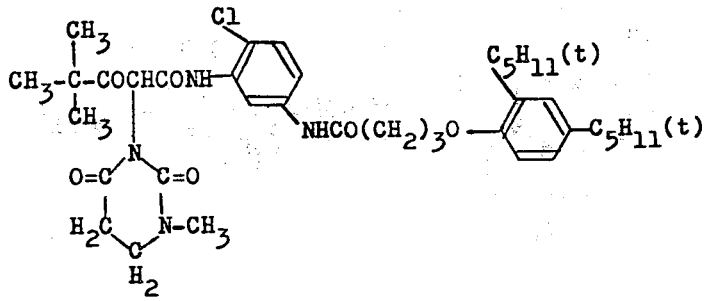
(39)
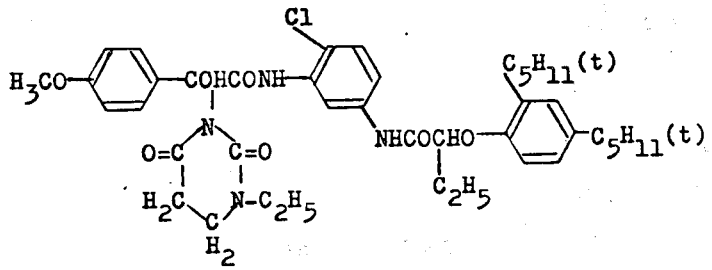
(40)
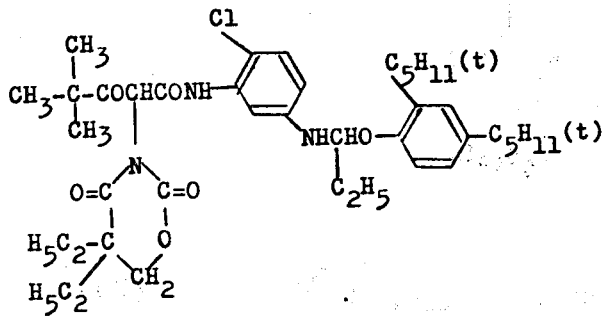
(41)
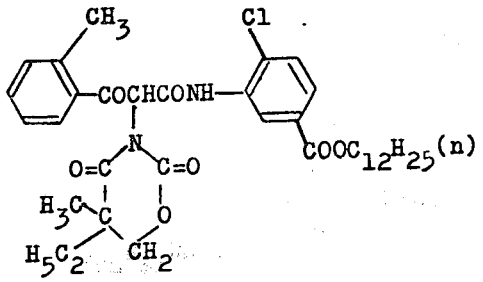

(42)
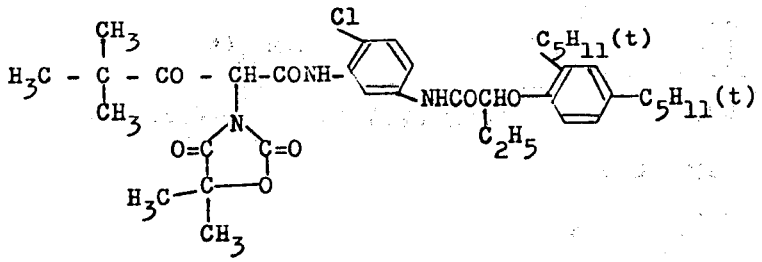
(43)
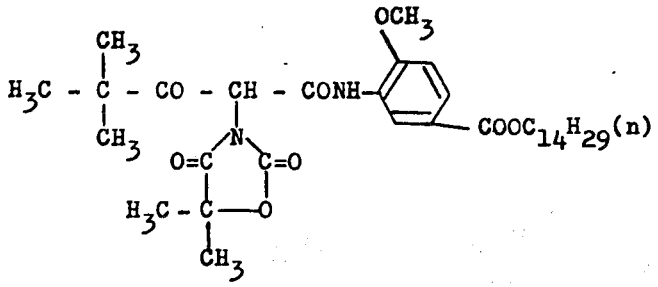
(44)
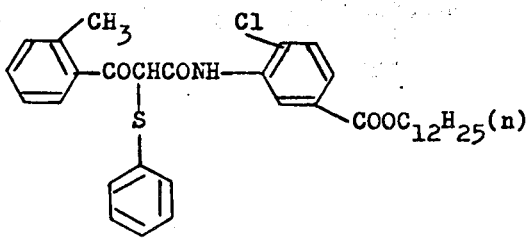
(45)
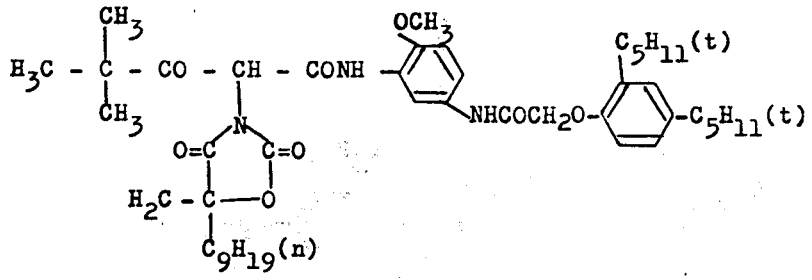
(46)
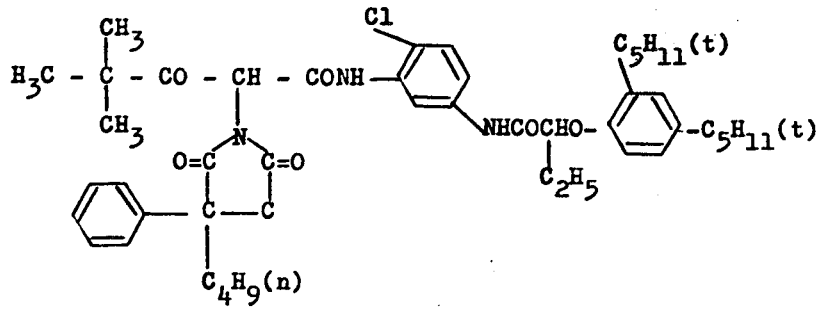
(47)
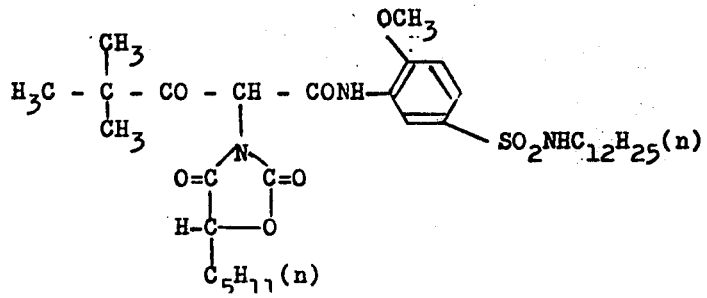

(48)
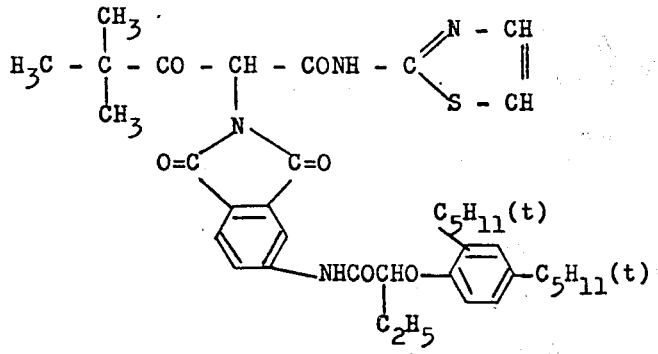
(49)
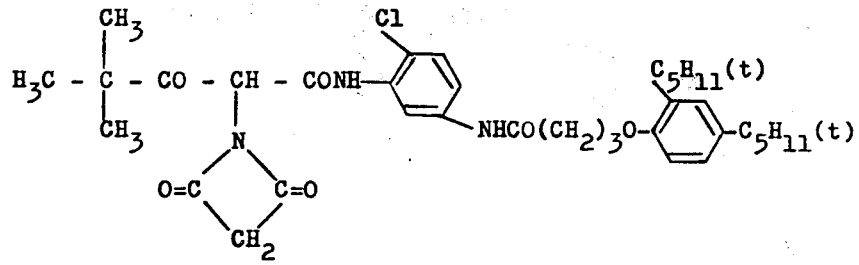
(50)
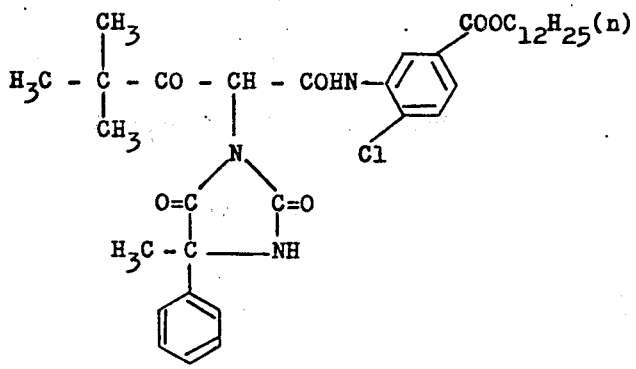
(51)
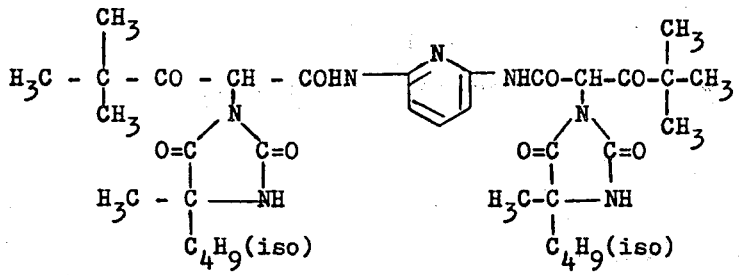
(52)
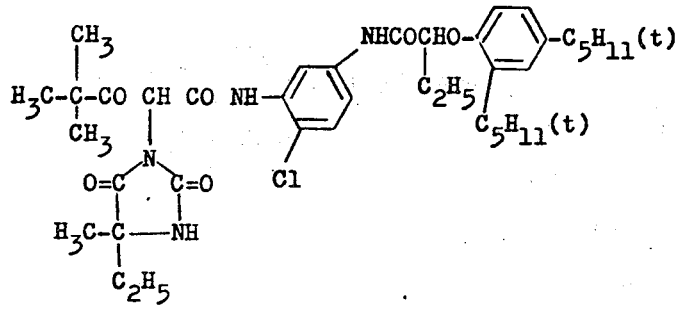

(53)
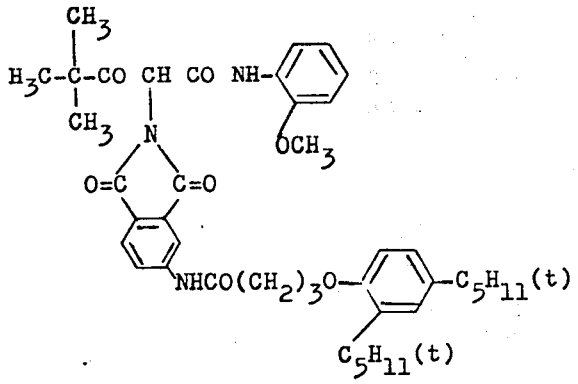
(54)
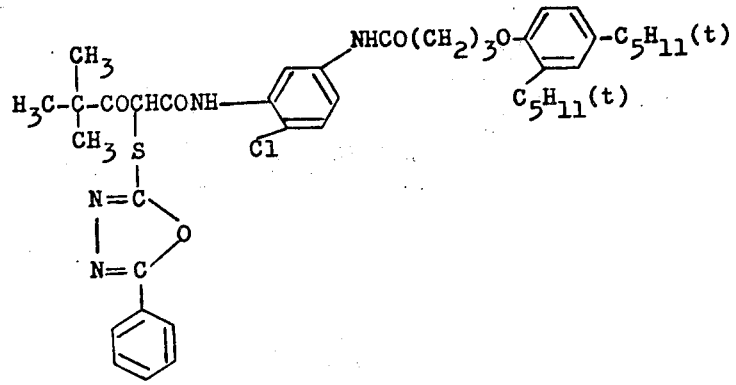
(55)
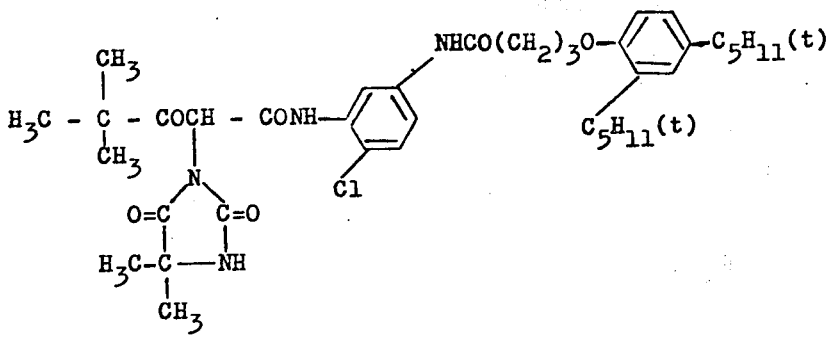
(56)
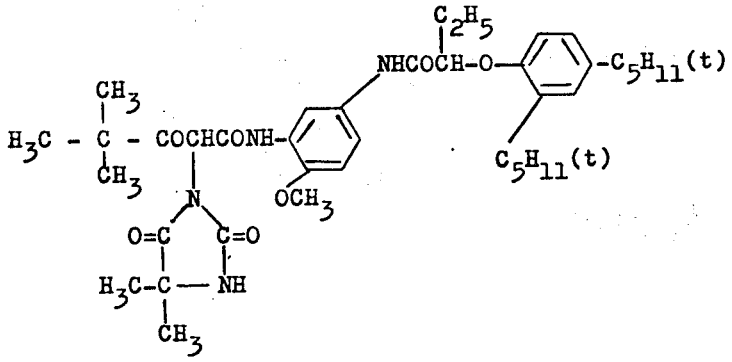
(57)
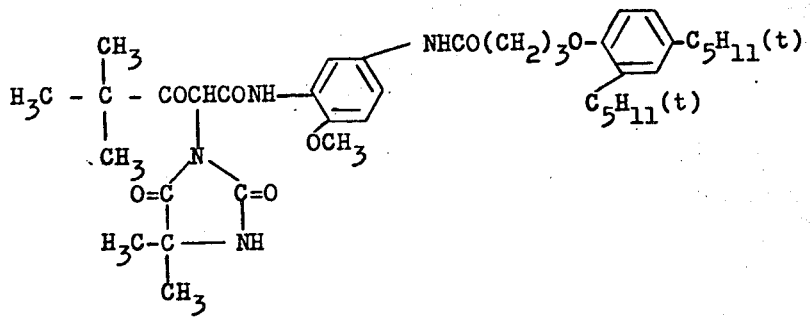

(58)
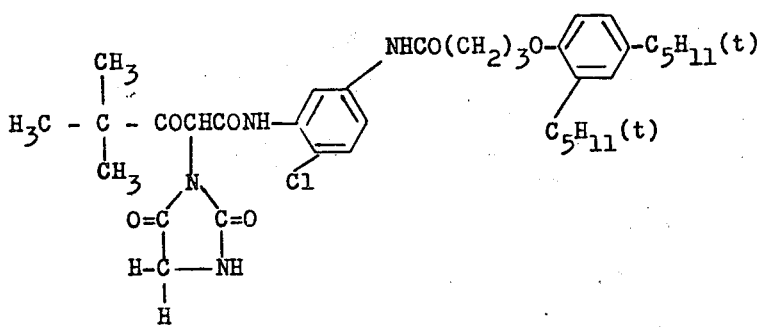
(59)
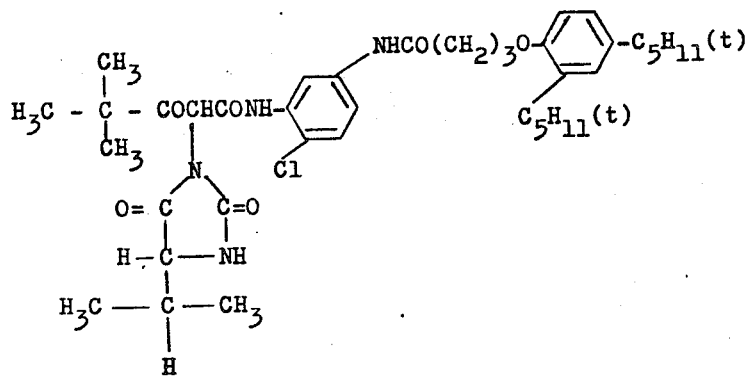
(60)
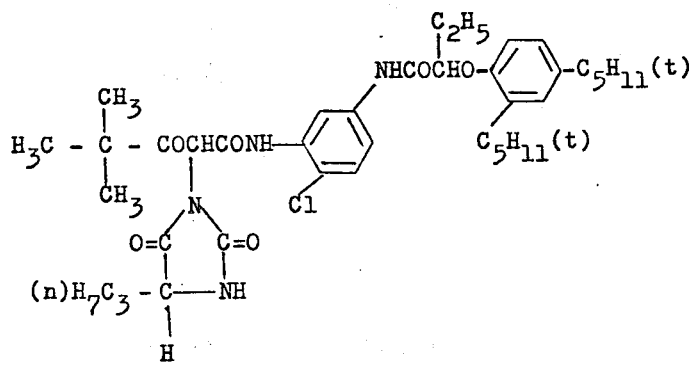
(61)
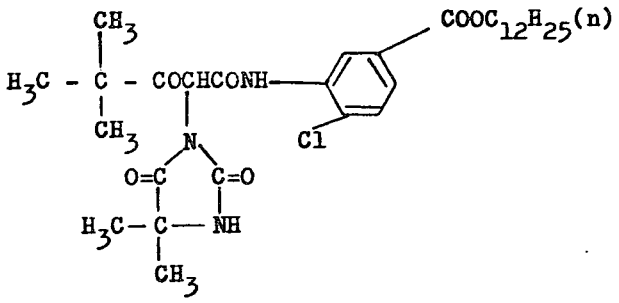
(62)
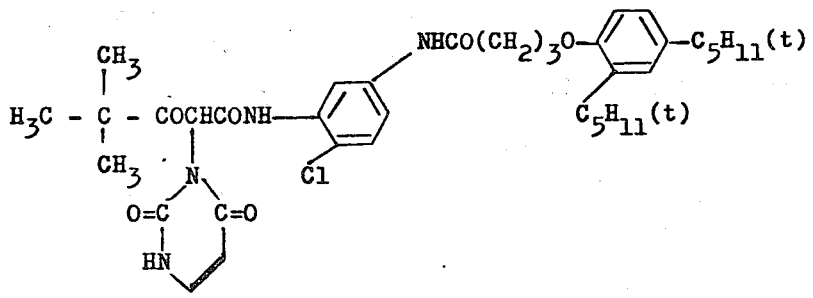

(63)
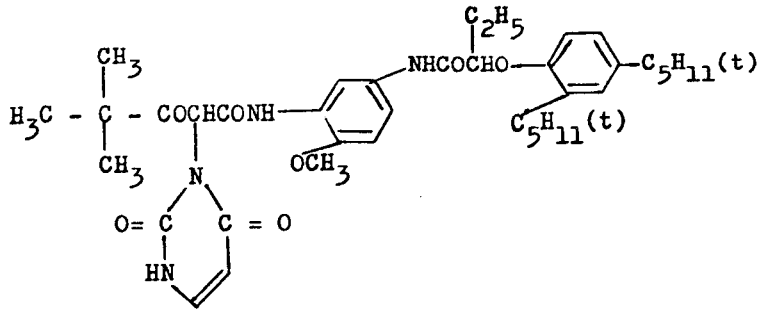
(64)
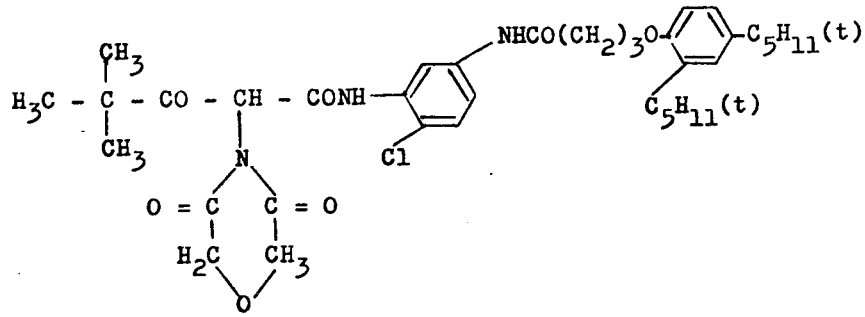
(65)
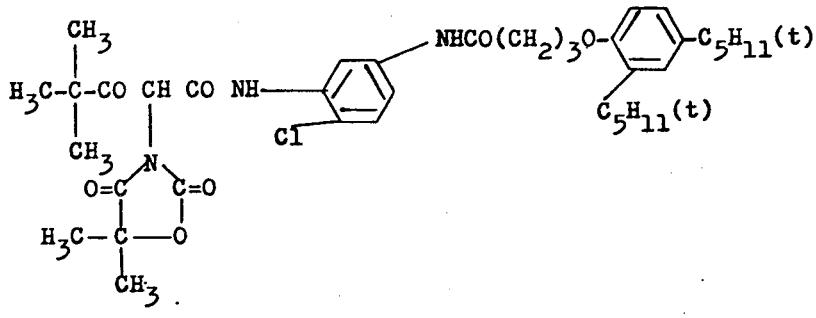
(66)
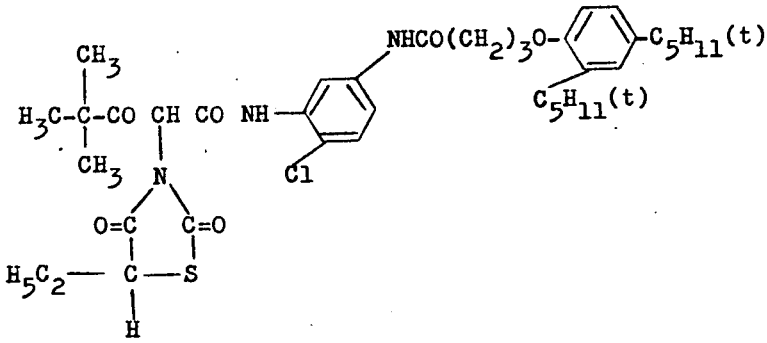
(67)
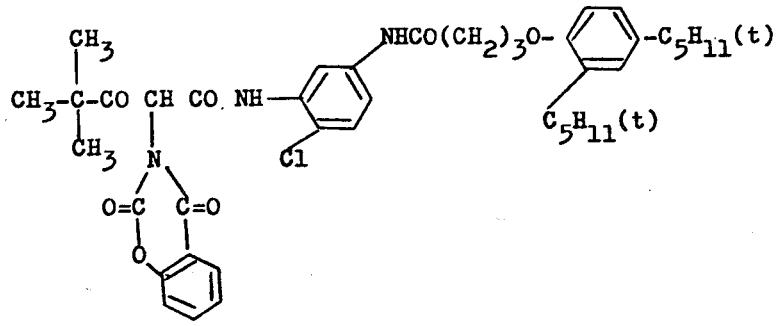

(68)
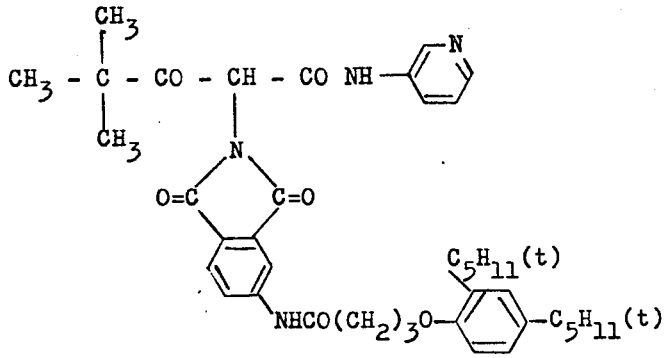
(69)
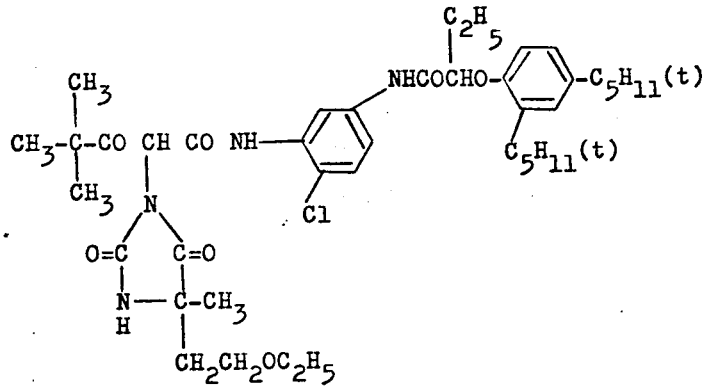
(70)
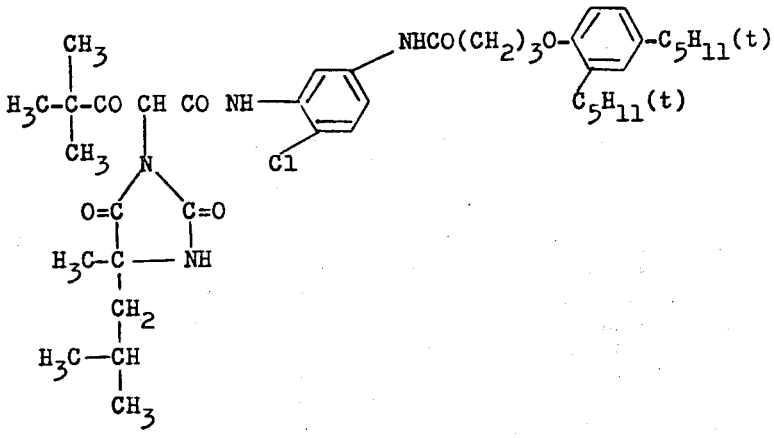
(71)
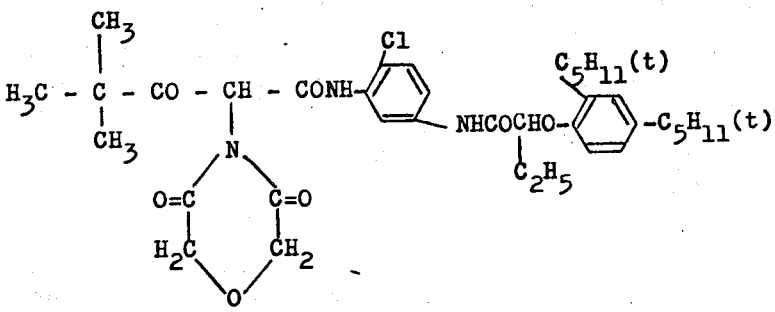

(72)

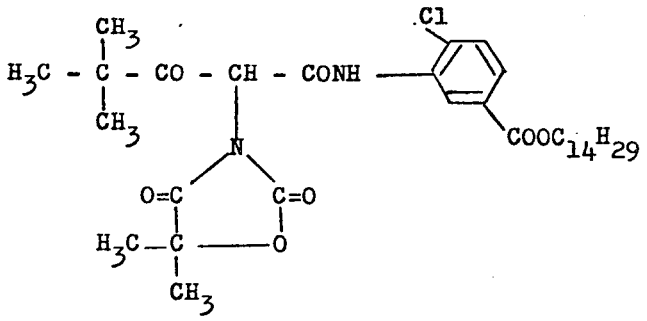

(73)

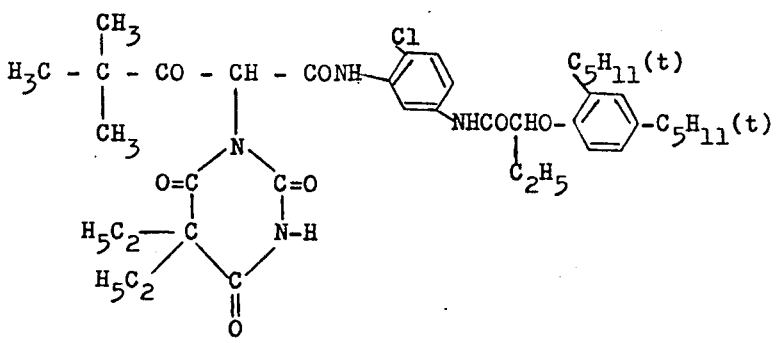

The two equivalent alpha-acylacetoamide yellow dye-forming couplers which can be used in the invention can be synthesized by halogenating one active hydrogen atom in the coupling position of the corresponding four equivalent yellow dye-forming coupler with chlorine or bromine, and reacting the resulting compound with the above described acid HX and a salt having an organic or inorganic salt group in a polar organic solvent. Suitable reaction methods are disclosed in U.S. Pat. Nos. 3,277,155, 3,408,194 and 3,447,928, German Pat. application laid open to public inspection (OLS) 2,057,941, U.S. Pat. application 235,937 filed Mar. 20, 1972 and U.S. Pat. application 319,806 filed Dec. 29, 1972. The four equivalent alpha-acylacetoamide which is a starting material for the synthesis can be synthesized using a condensation reaction of an alpha-acyl acetic acid ester with an amine. Suitable synthesis methods are disclosed in U.S. Pat. Nos. 2,350,138, 2,359,332, 2,407,210 2,875,057, 3,409,439, 3,551,155, 3,551,156, 3,265,506, 3,341,331, 3,649,276, British Pat. No. 1,296,411 and German Pat. No. 1,961,156.

The two equivalent yellow dye-forming coupler used in the invention can be used alone or as a mixture of two or more. The amount of the coupler is not specifically limited. However, usually about 0.2 to 5.0, preferably 0.6 to 3.0, millimol of the coupler per square meter of the light-sensitive material is usually used. The coupler can be used together with a four equivalent yellow dye-forming coupler, if desired. The coupler can be incorporated into a light-sensitive photographic material using conventional techniques.

The color photographic silver halide light-sensitive material of the invention comprises a support having coated thereon at least one hydrophilic colloid layer containing light-sensitive silver halide particles, a two equivalent alpha-acylacetoamide yellow dye-forming coupler and a monoalkylhydroquinone. These three components are present in the photographic material to prevent color fog by their interaction when the photographic material is processed in the developing step. Therefore, the components can be incorporated in the same layer or alternatively one or more of the components can be incorporated in different layers. In order to attain an usual purpose, it is suitable that the light-sensitive silver halide particles and the two equivalent alpha-acylacetoamide yellow dye-forming coupler are incorporates as a mixture in one emulsion layer. On the other hand, the monoalkylhydroquinone, although depending on the number of carbon atoms in the alkyl group substituent, is diffusible in the hydrophilic colloid layer under alkaline conditions. Generally speaking, the lower the number of carbon atoms in the alkyl group or substituted alkyl group substituent, the more easily the monoalkylhydroquinone can move and the greater the number of carbon atoms, the more difficult diffusion becomes. Accordingly, the monoalkylhydroquinone having an alkyl group substituent of not less than 10 carbon atoms is preferably incorporated in the same layer as or in an adjacent layer to the layer, in which the light-sensitive silver halide particles and the two equivalent alpha-acylacetoamide yellow dye-forming coupler are incorporated. The hydrophilic colloid layer in which the monoalkylhydroquinone can be incorporated, can comprise only a hydrophilic colloid, or can be a layer containing light-sensitive silver halide particles, a colloidal silver and/or a dye.

The amount of the monoalkylhydroquinone can be widely varied depending on factors such as the kind of light-sensitive material, the kind of two equivalent yellow dye-forming coupler, the kind of silver halide emulsion or the kind of development step employed. Generally, however, the amount ranges from about 0.2 to 8 wt. percent, preferably 0.5 to 5 wt. percent, to the weight of the two equivalent yellow dye-forming coupler.

The color photographic light-sensitive material of the invention includes a multi-layer multi-color photographic light-sensitive material comrising a support having coated thereon three silver halide emulsion layers having different sensitivities in different spectral regions. As a typical example of such a color photographic light-sensitive material is a color photographic light-sensitive material comprising a support having coated thereon a red-sensitized silver halide emulsion layer containing a cyan dye-forming coupler, a green-sensitized silver halide emulsion layer containing a magenta dyeforming coupler and a blue-sensitive silver halide emulsion layer containing a yellow dye-forming coupler, and if desired, a non-light-sensitive auxiliary layer such as a protective or overcoat layer, a filter layer, an antihalation layer or an intermediate layer.

In order to incorporate a monoalkylhydroquinone into a photographic light-sensitive material, any method for incorporating a color dye-forming coupler into a photographic light-sensitive material can be applied. Suitable methods are described in, for example, U.S. Pat. Nos. 2,304,939; 2,322,027; 2,801,170 – 1; 2,949,360; 3,253,921, etc. For example, the monoalkylhydroquinone can be dispersed in a hydrophilic colloid together with a high boiling organic solvent or it can be added as an alkaline solution to a hydrophilic colloid.

Suitable supports which can be used for the light-sensitive material of the invention can be any kind of supports known in the photographic art, for example, plastic films such as cellulose acetate, polycarbonate, polyethylene terephthalate or polystyrene, baryta papers, polyethylene-laminated papers or glass plates.

The hydrophilic colloid used for light-sensitive material of the invention is a high molecular weight compound capable of forming a layer and permitting the permeation of a processing solution. In other words, all kinds of hydrophilic colloids used in the photographic art can be used, such as gelatin, acylated gelatin, graft gelatin, polyvinyl alcohol, polyacrylate, polyacrylamide, partially hydrolized polyvinyl acetate, polyacrylamide treated by Hoffman reaction, acrylic acid-acrylamide-N-vinylimidazole copolymer, polyvinyl pyrrolidone or sodium alginate.

The hydrophilic colloid layer, especially containing gelatin, of color photographic light-sensitive material in the invention can be hardened with various cross-linking agents such as inorganic compounds, e.g., a chromium salt or zirconium salt, aldehyde type hardening agents, e.g. mucochloric acid or 2-phenoxy-3-chloromaleic aldehyde acid disclosed in Japanese Pat. Publication No. 1,872/71, especially non-aldehyde type hardening agents e.g., polyepoxy compounds disclosed in Japanese Pat. Publication No. 7,133/59, poly-(1-aziridinyl) compound disclosed in Japanese Pat. Publication No. 8,790/62 or active halogen compounds disclosed in U.S. Pat. Nos. 3,362,827 and 3,325,287.

A silver halide emulsion used for light-sensitive material of the invention can be selected from coventional various emulsions depending on the end-use purpose of the light-sensitive materials. Suitable silver halides include silver chloride, silver chlorobromide, silver bromide and silver chloroiodobromide. Also, the so-called converted halide silver halide grains as described in U.S. Pat. No. 3,622,318 and British Pat. No. 635,841 can be used. These photographic emulsions can be sensitized with a chemical sensitizer as disclosed, e.g., in U.S. Pat. Nos. 1,574,944; 2,399,083; 2,410,689; 2,487,850; 2,521,925; 2,540,085; 2,642,361; and 2,983,609, such as a sulfur sensitizer, a gold sensitizer or a reducing sensitizer. These emulsions can be stabilized with a slightly-soluble silver salt forming agent such as a mercapto compound (e.g., 1-mercapto-5-phenyltetrazole), or a stabilizer such as 5-methyl-6-oxy-1,3,4-triazaindolizine as disclosed, e.g., in U.S. Pat. Nos. 2,131,038; 2,377,375; 2,394,198; 2,403,927; 2,691,588; 2,708,162; 2,728,663 – 7; and 3,163,536. The emulsions can contain a sensitizing dye such as a cyanine dye or a merocyanine dye as disclosed, e.g., in U.S. Pat. Nos. 2,519,001; 2,666,761; 2,739,964; and 3,481,742. As a silver halide emulsion, a negative type emulsion is especially preferred, but a direct positive emulsion, e.g., an internal latent image-forming type emulsion containing an electron donating agent or solarization type emulsion, as disclosed, e.g., in U.S. Pat. Nos. 2,801,171; and 3,501,305 – 6, can be also used.

The combination of a 2-equivalent alpha-acylacetoamide yellow dye-forming coupler and a monoalkylhydroquinone according to the present invention can be applied to color photographic light-sensitive materials as described in U.S. Pat. Nos. 3,582,322; 3,622,318; 3,547,640; 3,672,898; 3,516,831; 3,705,799 – 803; 3,703,375; 3,379,529; 3,639,417; 3,402,046; and 3,450,536; U.S. Pat. applications Ser. No. 206,060, filed Dec. 8, 1971; and Ser. No. 29,666, filed Apr. 17, 1970 and British Pat. No. 923,045.

The light-sensitive material of the invention can be used for many purposes, for example, as color positive films, color print papers, color negative films or color reversal films.

The color photographic light-sensitive material of the invention, is exposed and then processed using conventional techniques to form color images. Basic processing steps include color development, bleaching and fixing, and, if necessary, washing, stabilizing, etc. Two or more of these steps can be carried out simultaneously, such as bleaching and fixing in a bleach-fixing step as described in U.S. Pat. No. 3,582,322. Color development is carried out in an aqueous alkaline solution containing an aromatic primary amino developing agent. A typical type of an aromatic primary amino developing agent is a p-phenylenediamine type amino developing agent. Typical specific examples of developing agents include 4-amino-3-ethoxy-N,N-diethylamine, 4-amino-3,5-dimethyl-N,N-diethylaniline, 4-amino-3-methyl-N-ethyl-N-(β-hydroxyethyl)aniline, 4-amino-3-methyl-N,N-diethylaniline, 4-amino-3-methyl-N-ethyl-N-(β-methylsulfonamidoethyl)aniline, 4-amino-3-(β-methylsulfonamidoethyl)-N,N-diethylaniline, 4-amino-N-ethyl-N-(β-hydroxyethyl)aniline, 4-amino-N,N-diethylaniline and 4-amino-N-ethyl-N-ω-sulfobutylaniline. Color development, the processing solutions and the components contained therein are well known in the art, for example, as disclosed in *J. Am. Chem. Soc.*, vol. 73, pages 3100–3125 (1951); *J. Phot. Sci. Eng.*, vol. 8, No. 3, pages 125–137 (1964); C. E. K. Mees and J. H. James, James, *The Theory of the Photographic Process*, IIIrd Ed., pages 294–295 (1966); U.S. Pat. Nos. 2,592,364; and 2,193,015 and such can be appropriately selected by one skilled in the art.

The invention will now be explained in greater detail by reference to the following examples. Unless otherwise indicated, all parts, percents, ratios and the like are by weight.

EXAMPLE 1

A solution obtained by heating 6.5 g of the above-described Coupler (11), one of the following hydroquinone derivatives, 3.0 ml of dibutyl phthalate and 20 ml of ethyl acetate to 60°C was added to 100 ml of an aqueous solution containing 10 g of gelatin and 0.5 g of sodium dodecylbenzenesulfonate and the mixture was stirred. Then, the mixture was passed 5 times through a heated colloid mill to prepare a dispersion of the coupler dissolved in the solvent.

The thus prepared coupler dispersion was added to 120 g of a photographic emulsion containing 6.0 g of silver chlorobromide (mean grain size 0.7 micron, bromide content 65 mol percent) and 8.9 g of gelatin. Further, 5 ml of a 3 percent methanol solution of triethylene phosphamide was added to the photographic emulsion which was then coated on a cellulose triacetate film so as to have a dry thickness of 5.5 microns. On this layer, a gelatin protective layer was coated in a dry thickness of 1 micron to provide a light-sensitive photographic material including about 2.3 millimol/m² of the coupler.

As the hydroquinone derivatives, the compounds (d), (e) and (g), and for the comparison, 2,5-di-tert-octylhydroquinone (Compound A), 2,5-di-n-octylhydroquinone (Compound B), 2,5-di-tert-amylhydroquinone (Compound C) and 4′-methylphenylhydroquinone (Compound D) were used. The comparison compounds employed have the following structural formula, (A)

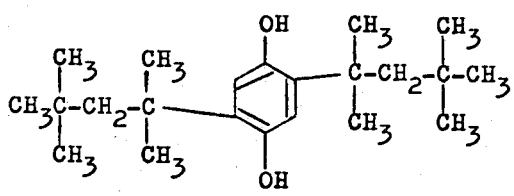

(B)

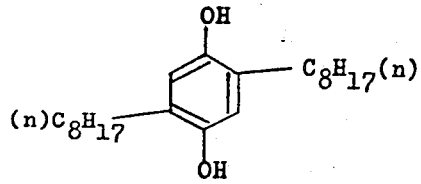

(C)

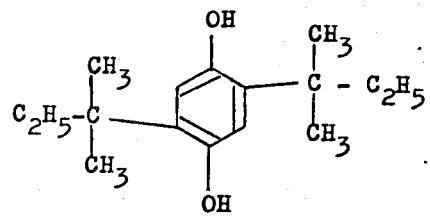

(D)

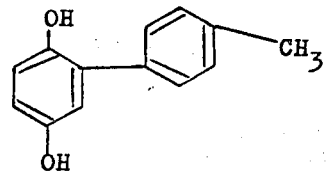

Each of the photographic light-sensitive materials was exposed using a sensitometric step wedge and then was processed using the following steps.

| Step | Temperature | Time |
|---|---|---|
| 1. Color Development | 32°C | 3 min. |
| 2. Stop | " | ½ " |
| 3. First Fix | " | 2 " |
| 4. Wash | " | ½ " |
| 5. Bleach | " | 2 " |
| 6. Wash | " | 1 " |
| 7. Second Fix | " | 1 " |
| 8. Wash | about 20°C | 3 " |

The color developer composition employed is shown below,

| | | |
|---|---|---|
| 4-Amino-3-methyl-N,N-diethylaniline Hydrochloride | 2.5 | g |
| Sodium Sulfite (anhydrous) | 3.0 | g |
| Sodium Carbonate (monohydrate) | 47.0 | g |
| Potassium Bromide | 2.0 | g |
| Water to make | 1 | liter |

The stopping solution was an aqueous acid solution containing acetic acid, the fixing solution was an aqueous acid solution containing sodium thiosulfate and sodium sulfite and the bleaching solution was an aqueous neutral solution containing potassium ferricyanide and potassium bromide.

The optical density of each sample to blue light was measured after these processing steps and the results obtained are shown in Table 1. The thus obtained color image was a clear yellow color having an absorption maximum at a wave length of 455 mμ.

Table I

| Sample | | Hydroquinone Derivative | Amount Added (g) | Fog | Relative* Sensitivity | Maximum Density | Fog** |
|---|---|---|---|---|---|---|---|
| Control | I-1 | | | 0.41 | 100 | 4.2 | 0.50 |
| Invention | I-2 | (d) | 0.1 | 0.22 | 105 | 4.2 | 0.30 |
| " | I-3 | " | 0.2 | 0.18 | 105 | 4.1 | 0.25 |
| " | I-4 | " | 0.3 | 0.10 | 95 | 4.1 | 0.14 |
| " | I-5 | (e) | 0.1 | 0.20 | 110 | 4.1 | 0.28 |
| " | I-6 | " | 0.2 | 0.17 | 100 | 4.1 | 0.20 |
| " | I-7 | " | 0.3 | 0.15 | 90 | 4.2 | 0.18 |
| " | I-8 | (g) | 0.2 | 0.25 | 110 | 4.0 | 0.31 |
| " | I-9 | " | 0.3 | 0.20 | 110 | 4.1 | 0.24 |
| " | I-10 | " | 0.5 | 0.15 | 95 | 4.1 | 0.18 |
| Comparison | I-11 | (A) | 0.1 | 0.39 | 105 | 4.0 | 0.46 |
| " | I-12 | " | 0.2 | 0.35 | 85 | 3.9 | 0.42 |
| " | I-13 | " | 0.3 | 0.28 | 60 | 3.9 | 0.35 |
| " | I-14 | (B) | 0.2 | 0.40 | 100 | 4.0 | 0.47 |
| " | I-15 | " | 0.3 | 0.35 | 90 | 3.9 | 0.40 |
| " | I-16 | " | 0.5 | 0.35 | 75 | 4.0 | 0.38 |
| " | I-17 | (C) | 0.2 | 0.30 | 100 | 4.0 | 0.34 |
| " | I-18 | " | 0.3 | 0.30 | 85 | 3.9 | 0.30 |
| " | I-19 | " | 0.5 | 0.28 | 60 | 3.8 | 0.30 |
| " | I-20 | (D) | 0.1 | 0.34 | 85 | 4.0 | 0.42 |
| " | I-21 | " | 0.2 | 0.30 | 70 | 4.1 | 0.38 |

*The relative sensitivity is shown as that sensitivity corresponding to the exposure amount necessary for obtaining a density of (fog + 0.1) as 100.
**The fog is for a developing time of 4 minutes 30 seconds.

From the results shown in the Table 1, it is apparent that the light-sensitive materials of the invention (I-2 to I-10) containing hydroquinone derivatives (d), (e) and (g) which are nonsubstituted with an aliphatic group have less color fog than that of sample I-1. In this case, the sensitivity and maximum density are not practically reduced. Further, they have less fog with increased developing time. On the contrary, the light-sensitive materials for comparison (I-11 to I-21) containing hydroquinone derivatives (A), (B), (C) and (D) which are disubstituted with an aliphatic or aromatic group have insufficiently reduced color fog and have remarkably reduced sensitivity.

EXAMPLE 2

A solution obtained by heating 7.5 g of the above-described Coupler (15), 200 mg of the above-described compound (d), 4.0 ml of dibutyl phthalate and 20 ml of ethyl acetate to 60°C was added to 100 ml of an aqueous solution of 10 g of gelatin and 0.5 g of sodium dodecylbenzenesulfonate. Then, the mixture was passed 5 times through a heated colloid mill to prepare a dispersion of the coupler dissolved in the solvent.

The coupler dispersion was mixed with 120 g of a photographic emulsion containing 6.0 g of silver chlorobromide (mean grain size 0.7 micron, bromide content 65 mol percent) and 8.9 g of gelatin. Further, 5 ml of a 3 percent methanol solution of triethylene phosphamide as a hardening agent was added to the mixture which was then coated on a cellulose triacetate film so as to have a dry thickness of 5.5 microns. On this layer, a gelatin protective colloid layer was coated to provide a light-sensitive photographic material II-1.

The same procedure as described above was repeated except that compound (d) was not added to provide a photographic material II-2. The photographic materials II-1 and II-2 contained the coupler in an amount of about 2.3 millimol/m$^2$.

A solution obtained by heating to 60°C 6.2 g of α-4-methoxybenzoyl-2'-chloro-5'-[α-(2'',4''-di-tert-amylphenoxy)-butylamido]-acetoanilide (Compound E) which is an α-position unsubstituted acylacetoamide compound, 200 mg of the above compound (d), 4.0 ml of dibutyl phthalate and 20 ml of ethyl acetate was added to 100 ml of an aqueous solution containing 10 g of gelatin and 0.5 g of sodium dodecylbenzenesulfonate and then stirred. The mixture was passed 5 times through a heated colloid mill to provide a dispersion of the coupler dissolved in the solvent.

The thus prepared coupler dispersion was mixed with 240 g of the above described silver chlorobromide emulsion and then 7.2 ml of a 3 percent methanol solution of triethylene phosphamide as a hardening agent was added to the mixture. The coating composition was coated on a cellulose triacetate film so as to have a dry thickness of 7.0 microns. On this layer, a gelatin protective layer was further coated in a dry thickness of 1 micron to prepare a light-sensitive photographic material II-3.

The same procedure used in the preparation of light-sensitive photographic material II-3 except that the compound (d) was not added was repeated to provide a light-sensitive photographic material II-4. The photographic materials II-3 and II-4 contained the coupler in an amount of about 2.3 millimol/m$^2$.

The photographic light-sensitive material each was exposed using a sensitometric step wedge and then processed in the same manner as described in Example 1. The optical density of each sample to blue light was measured, and the results obtained are shown in Table 2. The thus obtained color images were a clear yellow color having an absorption maximum at a wave length of 453 mμ.

Table 2

| Sample | Coupler | Compound (d) | Fog | Relative Sensitivity | Maximum Density |
|---|---|---|---|---|---|
| II-1 | (15) | present | 0.04 | 92 | 4.3 |
| II-2 | " | none | 0.24 | 100 | 4.3 |
| II-3 | (E) | present | 0.03 | 60 | 3.5 |

Table 2-continued

| Sample | Coupler | Compound (d) | Fog | Relative Sensitivity | Maximum Density |
|---|---|---|---|---|---|
| II-4 | " | none | 0.12 | 80 | 3.6 |

The results in Table 2 show that the photographic material II-1 (invention) has a reduced fog, an increased maximum density and a sufficient sensitivity. On the contrary, the photographic material II-2 containing no compound (d) has a remarkably increased fog, and the photographic materials II-3 and II-4 containing a 4-equivalent coupler (E) have reduced sensitivity and maximum density. It is believed from these evaluations that the present invention is excellent in the formation of yellow dye images having better photographic properties.

Further, a 0.2 percent methanol solution of 1-mercapto-2-phenyltetrazole (Compound F), well-known as an antifoggant, was added to the silver chlorobromide emulsion before adding the coupler dispersion in the preparation of the photographic material II-2 to provide photographic materials II-5 to II-7. The sensitometry of these samples is shown in Table 3.

Table 3

| Sample | Compound (d) | Compound (F) (ml) | Fog | Relative Sensitivity | Maximum Density |
|---|---|---|---|---|---|
| II-1 | present | 0 | 0.04 | 92 | 4.3 |
| II-2 | none | 0 | 0.24 | 100 | 4.3 |
| II-5 | " | 3 | 0.18 | 75 | 4.2 |
| II-6 | " | 6 | 0.14 | 62 | 4.0 |
| II-7 | " | 9 | 0.08 | 35 | 3.5 |

From the results in Table 3, it is apparent that fog is not sufficiently reduced and sensitivity is remarkably reduced, even if the antifoggant is added to the conventional photographic material. That is, the photographic properties corresponding to the photographic material II-1 can not be obtained by using an antifoggant.

EXAMPLE 3

Photographic materials were prepared using the same procedure as in the preparation of the sample II-1 of Example 2 except that the coupler (15) and the compound (d) were replaced with a 2-equivalent acylacetoamide yellow-dye forming coupler and monoalkyl hydroquinone as shown in Table 4. In the preparation of the sample III-10, cyclohexanone was used in place of ethyl acetate.

These photographic materials were exposed using a sensitometric step wedge and processed in the same manner as described in Example 1. After the processing, the optical density to blue light was measured, and the results obtained are shown in Table 4. The α-acyl-(α-substituted)acetoamide coupler can form a yellow dye image having a reduced fog and a sufficiently higher color density in the presence of a monoalkylhydroquinone.

Table 4

| Sample | Coupler No. | Without Hydroquinone Derivative: Amount Added (g) | Fog | Maximum Density | With Hydroquinone Derivative: No. | Amount Added (g) | Fog | Maximum Density | Absorption Maximum of Color Image (mμ) |
|---|---|---|---|---|---|---|---|---|---|
| III-1 | (1) | 7.2 | 0.16 | 3.8 | (g) | 0.09 | 0.05 | 3.7 | 450 |
| -2 | (2) | 7.0 | 0.14 | 3.7 | (g) | 0.09 | 0.04 | 3.7 | 450 |
| -3 | (3) | 8.0 | 0.16 | 3.7 | (d) | 0.10 | 0.03 | 3.6 | 451 |
| -4 | (4) | 7.1 | 0.16 | 3.9 | (f) | 0.09 | 0.04 | 3.7 | 452 |
| -5 | (6) | 6.3 | 0.14 | 3.6 | (i) | 0.08 | 0.07 | 3.5 | 451 |
| -6 | (7) | 7.5 | 0.17 | 3.2 | (e) | 0.09 | 0.05 | 3.0 | 450 |
| -7 | (9) | 6.5 | 0.32 | 4.5 | (a) | 0.16 | 0.10 | 4.4 | 447 |
| -8 | (13) | 6.3 | 0.29 | 4.5 | (b) | 0.16 | 0.08 | 4.5 | 455 |
| -9 | (17) | 8.0 | 0.28 | 4.3 | (c) | 0.20 | 0.06 | 4.3 | 454 |
| -10 | (20) | 9.0 | 0.25 | 4.2 | (d) | 0.22 | 0.08 | 4.1 | 453 |
| -11 | (22) | 6.8 | 0.23 | 4.2 | (f) | 0.17 | 0.11 | 4.2 | 454 |

EXAMPLE 4

A solution obtained by heating 7.7 g of the above described coupler (16), 150 mg of the above described compound (g), 2.5 ml of dibutyl phthalate, 35 ml of ethyl acetate and 0.4 g of the sodium salt of dioctyl α-sulfosuccinate at reflux was added to 120 ml of an aqueous solution containing 10 g of gelatin, 0.1 g of succinic acid and 0.05 g of sodium acid sulfite, and the mixture then was vigorously stirred using a homogenizer for 10 minutes to provide a dispersion.

The dispersion was mixed with 200 g of a blue-sensitive silver halide emulsion containing 52 millimol of silver chloroiodobromide (mean grain size 0.6 micron, halogen content: iodide 2 mol percent, bromide 83 mol percent, chloride 15 mol percent), 12 g of gelatin and 30 ml of 5-methyl-6-hydroxy-1,3,4-triazaindolizine. To the mixture, 5 ml of a 4 percent aqueous solution of 2-hydroxy-4,6-dichloro-s-triazine sodium salt and 2 ml of a 5 percent aqueous solution of sodium dodecyl sulfate were added. The thus prepared coating composition was coated on a polyethylene laminated paper in a dry thickness of 2.5 microns. The blue-sensitive silver halide emulsion layer contained 720 mg/m² (0.93 millimol/m²) of the coupler, 14 mg/m² of the compound (g) and 4.9 millimol/m² of silver halide.

On the blue-sensitive silver halide emulsion layer, there were coated an intermediate layer containing gelatin in a thickness of 2 microns as a second layer, a green-sensitized silver halide emulsion layer, as a third layer, containing 695 mg/m² of 1-(2′,4′,6′-trichlorophenyl)-3-{3″-[α-(2‴,4‴-tert-amylphenoxy)- butylamido]benzamido}-5-pyrazolone, 45 mg/m² of 2,5-di-tert-octyl-hydroquinone, 70 mg/m² of 6,6'-dihydroxy-4,4,4',4',7,7'-hexamethyl-bis-2,2'-spirochroman and 1.5 g/m² of tri-n-hexylphosphate in a thickness of 4 microns, a gelatin layer as a fourth layer containing 0.4 g/m² of 2-benzotriazolyl-4-tert-butylphenol, 0.2 g/m² of 2-(5'-chlorobenzotriazolyl)-4-tert-methyl-6-tert-butylphenol, 20 mg of 2,5-di-tert-octylhydroquinone and 2 g/m² of dibutyl phthalate, a red-sensitized silver halide emulsion layer as a fifth layer containing 520 mg/m² of 2,4-dichloro-5-methyl-6- α-(2',4'-di-tert-amylphenoxy)butylamido phenol and 1.5 g/m² of dibutyl phthalate in a thickness of 2.5 microns and then a gelatin protective layer in a thickness of 1.5 microns to provide a color photographic paper IV-1.

The same procedure as described in the preparation of the color photographic paper IV-1, except that the compound (g) in the blue-sensitive layer, was replaced with 150 mg of 2,5-di-tert-octylhydroquinone (A) was repeated to provide a color photographic paper IV-2.

The same procedure as described in the preparation of the color photographic paper IV-1, except that the hydroquinone derivative was not included in the blue-sensitive layer, was repeated to provide a color photographic paper IV-3.

Further, by adding a 4-equivalent coupler (E) in place of the coupler (16) to the blue-sensitive layer, a color photographic paper was prepared as follows.

A solution obtained by heating 6.2 g of the coupler (E), 150 mg of the compound (g), 2.5 ml of dibutyl phthalate, 35 ml of ethyl acetate and 0.4 g of the sodium salt of dioctyl α-sulfosuccinate at reflux was added to 120 ml of an aqueous solution containing 10 g of gelatin, 0.1 g of succinic acid and 0.05 g of acid sodium sulfite and then stirred using a homogenizer for 10 minutes to provide a dispersion.

The dispersion was mixed with 400 g of a silver chlorobromide emulsion containing 104 millimol of silver, and then 7 ml of a 4 percent aqueous solution of sodium 2-hydroxy-4,6-dichloro-s-triazine and 2 ml of a 5 percent aqueous solution of sodium dodecylsulfate were added. The thus prepared coating composition was coated on a polyethylene-laminated baryta paper in a thickness of 3.5 microns. The blue-sensitive emulsion layer contained 580 mg/m² (0.93 millimol/m²) of the coupler, 14 mg/m² of the compound (g) and 9.7 millimol/m² of silver halide. In other words, the sample contained the coupler and the compound (g) in the same amounts as those of the sample IV-1, and contained silver halide in an amount twice that of the sample IV-1. On this layer, the same second to sixth layers as those of the sample IV-1 were coated to provide a color photographic paper IV-4.

The same procedure as described in the preparation of the color photographic paper IV-4, except that the compound (g) in the first layer was replaced with the hydroquinone derivative (A), was repeated to provide a color photographic paper IV-5.

The same procedure as described in the preparation of the color photographic paper IV-4, except that the hydroquinone derivative was omitted from the first layer, was repeated to provide a color photographic paper IV-6.

These samples were exposed to blue light, green light and red light using a sensitometric step wedge, and processed as follows.

| Step | Temperature | Time |
|---|---|---|
| 1. Color Development | 32°C | 2 min. |
| 2. Bleach-fix | " | 3 " |
| 3. Wash | 20°C | 4 " |

The color developer and bleach-fixing solution used in the above processings had the following compositions.

| | | |
|---|---|---|
| Color Developer | | |
| Benzyl Alcohol | 12 | g |
| Sodium Hexametaphosphate | 2 | g |
| Sodium Sulfite (anhydrous) | 2 | g |
| Sodium Carbonate (monohydrate) | 27.5 | g |
| Hydroxylamine Sulfate | 2.5 | g |
| 4-Amino-3-methyl-N-(β-methanesulfonamidoethyl)-N-ethylaniline Sesquisulfate (monohydrate) | 4 | g |
| Water to make | 1 | liter |
| Bleach-fixing Solution | | |
| Ammonium Thiosulfate | 105 | g |
| Sodium Sulfite | 80 | g |
| EDTA (disodium salt) | 35 | g |
| Ferric Chloride (hexahydrate) | 10 | g |
| Potassium Thiocyanate | 10 | g |
| Water to make | 1 | liter |

After the processing, an optical reflection density in the color image of the samples was measured using a monochromatic light, and the results obtained are shown in Table 5.

Table 5

| Sample | Yellow Coupler Forming Coupler | Hydroquinone Derivative in the Blue-Sensitive Emulsion Layer | Yellow Color Image (Measured with Blue Light) | | | Blue Light Density of Magenta Color Image |
|---|---|---|---|---|---|---|
| | | | Fog | Relative Sensitivity | Maximum Density | |
| IV-1 | (16) | (g) | 0.03 | 90 | 2.5 | 0.38 |
| -2 | " | (A) | 0.14 | 95 | 2.5 | 0.44 |
| -3 | " | — | 0.15 | 100 | 2.5 | 0.49 |
| IV-4 | (E) | (g) | 0.03 | 60 | 1.9 | 0.36 |
| -5 | " | (A) | 0.07 | 65 | 2.2 | 0.39 |
| -6 | " | — | 0.09 | 75 | 2.3 | 0.44 |

As is apparent from the results in Table 5, the color photographic paper IV-1 of the invention had a reduced fog, sufficient sensitivity and maximum density. On the contrary, where the hydroquinone derivative was replaced with a disubstituted hyroquinone or was not used, and a 4-equivalent yellow dye-forming coupler was used, sufficient results could not be obtained because fog was increased, color stain resulted on the white color areas of the photograph, the sensitivity was low or the color density was insufficient.

Further, the degree of color-mixing was tested by measuring the amount of yellow dye in the magenta color areas of each sample at the point of an optical density to green light of 1.5. When a 2-equivalent coupler was used in the absence of a hydroquinone derivative or in the presence of a di-substituted hydroquinone, yellow dye images in the first layer were formed in an increased amount by developing the green-sensitized emulsion layer. However, the color photographic paper IV-1 of the invention did not form such undesirable yellow dye images, and formed correct color images corresponding to optical sensitivity.

The light-stability of the yellow dye images by exposing these color photographic papers to blue light and processing them was measured. As a light-source, a xenon lamp with a heat-absorbing filter was used. The exposure amount of the sample was about 10,000 lux (30°C, 68 percent R.H., 60 days). The color density before and after exposure was measured to obtain the degree of light-stability thereof. The results obtained are shown in Table 6.

Table 6

| Sample | Yellow Dye-Forming Coupler | Hydroquinone Derivative in the First Layer | Light-Stability(%) Initial Density 1.0 | 2.0 |
|---|---|---|---|---|
| IV-1 | (16) | (g) | 10 | 6 |
| -2 | " | (A) | 18 | 10 |
| -3 | " | — | 10 | 5 |
| IV-4 | (E) | (g) | 17 | — |
| -5 | " | (A) | 27 | 17 |
| -6 | " | — | 15 | 9 |

It will be apparent from the results in Table 6 that a disubstituted hydroquinone remarkably reduces the light-stability of the yellow dye image, but that a monosubstituted hydroquinone hardly reduces the light-stability.

From the above evaluation, it can be concluded that the light-sensitive photographic material of the invention has advantageous photographic properties in that sensitivity, whiteness in the high light areas and the optical density in the shadow areas are higher, and that yellow dye images having excellent light-stability can be formed.

EXAMPLE 5

A solution obtained by heating 7.4 g of the above described coupler (2), 2 ml of tricresyl phosphate and 20 ml of ethyl acetate to 60°C was added to 120 ml of an aqueous solution containing 10 g of gelatin and 0.5 g of sodium dodecylbenzenesulfonate and stirred using a homogenizer for 10 minutes to prepare a coupler dispersion.

The dispersion was mixed with 154 g of a blue-sensitive emulsion containing 40 millimol of silver halide (mean grain size 0.6 micron, halogen content: iodide 2 mol percent, bromide 83 mol percent, chloride 15 mol pecent) and 9.2 g of gelatin. To the mixture, 5 ml of a 4 percent aqueous solution of sodium 2-hydroxy-4,6-dichloro-s-triazine as a hardening agent and 1 ml of a 0.2 percent methanol solution of 1-mercapto-2-phenyltetrazole as a stabilizer were added. The thus prepared coating composition was coated on a polyethylene-laminated baryta paper in a thickness of 3 microns to obtain a blue-sensitive emulsion layer which contained 930 mg/m² (1.25 millimol/m²) of the coupler and 5.0 millimol/m² of silver halide.

A solution obtained by heating 5 g of the above compound (d) and 15 g of dibutyl phthalate to 60°C was added to 120 ml. of an aqueous solution containing 10 g of gelatin, 0.2 g of sodium dodecylbenzenesulfonate, 0.1 g of succinic acid and 0.05 g of sodium acid sulfite, and then vigorously stirred using a homogenizer for 10 minutes to prepare a dispersion.

With 50 ml of aqueous solution containing 3 g of gelatin, 20 g of the dispersion was mixed, and 2 ml of a 4 percent aqueous solution of sodium 2-hydroxy-4,6-dichloro-s-triazine was added. The coating composition for the second layer was coated on the blue-sensitive emulsion layer in a thickness of 1.5 microns.

On this layer, a green-sensitized emulsion layer containing 550 mg/m² of 1-(2′,4′,6′-trichlorophenyl)-3-(2″-chloro-5″-lauroylamidoanilino)-5-pyrazolone, 40 mg/m² of 2,5-di-tert-octylhydroquinone, 70 mg/m² of 6,6′-dihydroxy-4,4,4′,4′,7,7′-hexamethyl-bis-2,2′-spirochroman and 1 g/m² of dibutyl phthalate was coated in a thickness of 4 microns. The third layer, fourth, fifth and sixth layers which were same as those in Example 4 were coated to provide a color photograhic paper V-1.

The same procedure as described in the preparation of the color photographic paper V-1, except that the compound (d) in the second layer was replaced with 2,5-di-tert-octylhydroquinone (A), was repeated to prepare a color photograhic paper V-2. Further, the same procedure as described in the preparation of the color photographic paper V-1, except that the hydroquinone derivative was omitted from the second layer, was repeated to prepare a color photographic paper V-3.

These color photographic papers were exposed to blue light through a step wedge and processed in the same manner as described in Example 4 in addition to varying the developing time. After the processing, the reflection optical density of the yellow dye image was measured using blue light. In this case, the development degree of the magenta dye-forming layer adjacent the yellow dye-forming layer by developing the blue-sensitive layer was tested by measuring the density to green light at the point corresponding to a density to blue light of 1.0 and 2.0. The results obtained are shown in Table 8.

Table 8

| Sample | Hydroquinone Derivative in the Second Layer | Fog Developing Time 2 min. | 3 min. | 4 min. | Color-Mixing Density of Magenta in Yellow Blue-Light Density 1.0 | 2.0 |
|---|---|---|---|---|---|---|
| V-1 | (d) | 0.02 | 0.02 | 0.04 | 0.05 | 0.08 |
| V-2 | (A) | 0.04 | 0.06 | 0.10 | 0.07 | 0.11 |
| V-3 | — | 0.12 | 0.16 | 0.22 | 0.11 | 0.18 |

Further, in order to test the light-stability of the color image, the same exposure test as used in Example 4 was carried out. The results obtained are shown in Table 9.

Table 9

| Sample | Hydroquinone Derivative in the Second Layer | Light-Stability (%) Initial Density 1.0 | 2.0 |
|---|---|---|---|
| V-1 | (d) | 7 | 3 |
| V-2 | (A) | 12 | 5 |
| V-3 | — | 8 | 3 |

It is apparent from the results in Tables 8 and 9 that the light-sensitive photographic material V-1 of the invention has more reduced fog, less magenta-mixing degree in the adjacent layer and better light-stability of the color images than the comparative samples V-2 and V-3 even when it is developed for a prolonged time.

When an exposed and developed color negative film was printed on a color photographic paper to prepare a color print, the print made using the color photographic paper V-1 of the invention gave a pure white background. In other words, it was better than the color photographic papers V-2 and V-3 because lemon yellow dye images were reproduced without any reddish color.

EXAMPLE 6 i. Preparation of Dispersion (I)

A heated solution of 80 g of 1-hydroxy-2-(N-dodecyl) naphthamide as a cyan dye-forming coupler, 65 ml of tricresyl phosphate, 110 ml of ethyl acetate, 5 g of sodium dodecylbenzenesulfonate and 30 ml of a 20 percent methanol solution of sorbitan monolaurate was dispersed in 100 ml of a gelatin aqueous solution using a mixer for 20 minutes.

ii. Preparation of Dispersion (II)

The same procedure as described in the preparation of the dispersion (I) was repeated except that the cyan dye-forming coupler was replaced with magenta dye-forming couplers, that is, 40 g of 1-(2,4,6-trichlorophenyl)-3-{3-(2,4-di-tert-amylphenoxy)acetoamide}benzamido-5-pyrazolone and 20 g of 1-(2,4,6-trichlorophenyl)-3-{3-(2,4-di-tert-amylphenoxy)acetoamido}benzamido-4-(4-methoxyphenyl)azo-5-pyrazolone.

iii. Preparation of Dispersion (III)

The same procedure as described in the preparation of the dispersion (I) was repeated except that the cyan dye-forming coupler was replaced with 120 g of 4-methoxy-2'-chloro-5'-{2-(2,4-di-tert-amylphenoxy)-butylamido}benzoylacetoanilide.

iv. Preparation of Dispersion (IV)

The same procedure as described in the preparation of the dispersion (I) was repeated except that the cyan dye-forming coupler was replaced with 120 g of the coupler (15) as a yellow dye-forming coupler.

v. Preparation of Dispersion (A)

A heated solution of 40 g of hydroquinone derivative (B), 40 g of dibutyl phthalate and 50 ml of a 20 percent methanol solution of sorbitan monolaurate was dispersed in a mixture of 100 ml of a 5 percent aqueous solution of sodium dodecylbenzenesulfonate and 1000 ml of a 10 percent aqueous solution of gelatin using a mixer for 20 minutes.

vi. Preparation of Dispersion (B)

The same procedure as described in the preparation of the dispersion (A) was repeated except that the hydroquinone derivative (B) was replaced with 40 g of the compound (e) of the invention.

vii. Preparation of the Coating Composition for the Red-Sensitized Emulsion Layer Into 1000 g of a high speed negative emulsion containing 65 g of silver iodobromide (iodide content 6.0 mol percent) and 100 g of gelatin, 70 ml of a 5 percent aqueous solution of 5-hydroxy-7-methyl-1,3,8-triazaindolizine and 250 ml of a 0.03 methanol solution of the following spectral sensitizer (1) were dispersed for 60 minutes at 40°C. To the dispersion, 450 g of the dispersion (I) and 30 g of the dispersion (A) were added and then 40 ml of a 2 % aqueous solution of sodium 2-hydroxy-4,6-dichloro-s-triazine was added. Spectral Sensitizer (1)

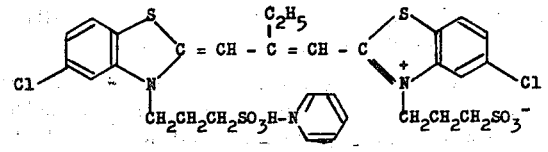

viii. Preparation of the Coating Composition for the Intermediate Layer

To 1000 g of a 10 percent aqueous gelatin solution, 100 ml of a 1 percent aqueous solution of sodium dodecylbenzenesulfonate, 80 g of the dispersion (A) and 100 ml of a 2 percent aqueous solution of sodium 2-hydroxy-4,6-dichloro-s-triazine were added.

ix. Preparation of the Coating Composition for the Green-Sensitized Emulsion Layer Into 1000 g of the same high speed negative emulsion as used in the preparation of the coating composition for the red-sensitized emulsion layer, 70 ml of a 5 percent aqueous solution of 5-hydroxy-7-methyl-1,3,8-triazaindolizine and 180 ml of a 0.0003 percent methanol solution of the following spectral sensitizer (2) were dispersed for 30 minutes at 40°C. To the dispersion, 300 g of the dispersion (II) and 30 g of the dispersion (A) were added and then 40 ml of a 2 percent aqueous solution of 2-hydroxy-4,6-dichloro-s-triazine was added. Spectral Sensitizer (2)

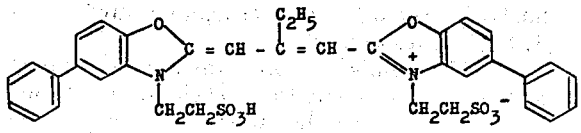

x. Preparation of the Coating Composition (I) for the Yellow Filter Layer

To 1000 g of a containing percent aqueous gelatin solution contaning 8 g of Carey-Lea type yellow colloid silver, 100 ml of a 1 percent aqueous solution of sodium dodecylbenzenesulfonate, 100 g of the dispersion (A) and 40 ml of a 2 percent aqueous solution of sodium 2-hydroxy-4,6-dichloro-s-triazine were added.

xi. Preparation of the Coating Composition for the Blue-Sensitive Emulsion Layer To 1000 g of the same high speed emulsion as used in the preparation of the coating composition for the red-sensitized emulsion layer, 20 ml of a 5 percent aqueous solution of 5-hydroxy-7-methyl-1,3,8-triazaindolizine, 800 g of the dispersion (III) and 70 g of the dispersion (A) were added and then 100 ml of a 2 percent aqueous solution of sodium 2-hydroxy-4,6-dichloro-s-triazine was added.

xii. Preparation of the Coating Composition (II) for the Blue-Sensitive Emulsion Layer The same procedure as used in the preparation of the coating composition (I) for the blue-sensitive emulsion layer was repeated except that the dispersion (A) was replaced with 70 g of the dispersion (B).

xiii. Preparation of the Coating Composition (III) for the Blue-Sensitive Emulsion Layer The same procedure as used in the preparation of the coating composition (I) for the blue-sensitive emulsion layer was repeated except that the dispersion (III) was replaced with 800 g of the dispersion (IV).

xiv. Preparation of the Coating Composition (IV) for the Blue-Sensitive Emulsion Layer The same procedure as used in the preparation of the coating Composition (I) for the blue-sensitive emulsion layer was repeated except that the dispersions (III) and (A) were replaced with 800 g of the dispersion (IV) and 70 g of the dispersion (B).

xv. Preparation of the Coating Composition for the OverCoat Layer

To 1000 g of a 5 percent aqueous gelatin solution, 80 ml of a 1 percent aqueous solution of sodium dodecylbenzenesulfonate and 100 ml of a 2 percent aqueous solution of sodium 2-hydroxy-4,6-dichloro-s-triazine were added.

xvi. Preparation of the Multi-Layer Color Light-Sensitive Material (I) to (IV)

On a cellulose triacetate film having a subbing layer, were coated the coating compositions for a red-sensitized emulsion layer, for an intermediate layer, for a green-sensitized emulsion layer, for a yellow filter layer, for a blue-sensitive emulsion layer and for an over-coat layer in this order. The amount of silver in each light-sensitive emulsion layer was 20 mg/100 cm². Coating compositions (I) to (IV) for the blue-sensitive emulsion layer were used for light-sensitive materials (I) to (IV), respectively.

The light-sensitive material was exposed through a continuous grey step wedge to a light source of 5400°K for 1/200 second and then processed using the following steps.

| Step | Temperature | Time |
|---|---|---|
| 1. Color Development | 37.8°C | 3 ½ min. |
| 2. Wash | " | 1 " |
| 3. Bleach | " | 6 " |
| 4. Wash | " | 1 " |
| 5. Fix | " | 6 " |
| 6. Wash | " | 1 " |
| 7. Stabilization | " | 1 " |

Each processing composition was as follows.

| | |
|---|---|
| Color Developer Composition | |
| Sodium Hydroxide | 2 g |
| Sodium Sulfite | 2 g |
| Potassium Bromide | 0.4 g |
| Sodium Chloride | 1 g |
| Borax | 4 g |
| Hydroxylamine Sulfate | 2 g |
| Ethylenediamine Tetaacetic Acid | 2 g |
| 4-Amino-3-methyl-N-ethyl-N-(β-hydroxyethyl)aniline Sesquisulfate(monohydrate) | 4 g |
| Water to make | 1 liter |
| Bleaching Solution | |
| Sodium Salt of Fe(III)-ethylenediamine Tetraacetic Acid | 100 g |
| Potassium Bromide | 50 g |
| Ammonium Nitrate | 50 g |
| Boric Acid | 5 g |
| Aqueous Ammonia Solution | an amount sufficient to adjust the pH to 5.0 |
| Water to make | 1 liter |
| Fixing Solution | |
| Sodium Thiosulfate | 150 g |
| Sodium Sulfite | 15 g |
| Borax | 12 g |
| Glacial Acetic Acid | 15 g |
| Potassium Alum | 20 g |
| Water to make | 1 liter |
| Stabilizing Solution | |
| Boric Acid | 5 g |
| Sodium Citrate | 5 g |
| Sodium Metaborate Tetrahydrate | 3 g |
| Potassium Alum | 15 g |
| Water to make | 1 liter |

After the processing, the blue, green and red light optical densities were measured and the results shown in Table 10 were obtained. The relative sensitivity was shown as 100 in the density of (fog + 0.2) of the light-sensitive material (I).

Table 10

| Light-Sensitive Material | | (I) | (II) | (III) | (IV) |
|---|---|---|---|---|---|
| Blue-Sensitive Layer (yellow color image) | Fog | 0.22 | 0.17 | 0.32 | 0.12 |
| | Relative Sensitivity | 100 | 100 | 85 | 110 |
| Green-Sensitive Layer (magenta color image) | Fog | 0.24 | 0.17 | 0.40 | 0.08 |
| | Relative Sensitivity | 100 | 105 | 80 | 120 |
| Red-Sensitive Layer (cyan color image) | Fog | 0.13 | 0.13 | 0.10 | 0.08 |
| | Relative Sensitivity | 100 | 100 | 110 | 110 |

Comparing the light-sensitive material (I) with the light-sensitive material (III), it is apparent that fog is increased by replacing a 4-equivalent coupler with a 2-equivalent coupler even if a dialkyl hydroquinone is contained. That is, a dialkyl hydroquinone has no inhibiting action to color fog caused by a 2-equivalent coupler. On the contrary, the light-sensitive material of the invention containing a monoalkylhydroquinone decreases color fog without reducing sensitivity. This better result can be obtained not only in the blue-sensitive emulsion layer but in the green-sensitized emulsion layer. In addition, the action of the monoalkylhydroquinone can be barely recognized in the light-sensitive material (II) containing a 4-equivalent coupler, and can be easily recognized only with a 2-equivalent coupler.

EXAMPLE 7

A solution obtained by heating 200 g of the above coupler (15), 50 ml of dibutyl phthalate, the compound (d) and 150 ml of ethyl acetate at 60°C was mixed with 1000 g of a 10% aqueous lime-treated gelatin solution containing 6 g of p-n-dodecylbenzene and the mixture was passed 3 times through a high-pressure milk homogenizer to prepare a fine dispersion, in which the average particle size of the coupler was 0.3 micron.

To 1000 g of a blue-sensitive silver halide emulsion, 500 g of the disperson was added. The emulsion contained silver iodobromide having a mean grain size of 0.75 micron, 55 g/l kg of gelatin and 0.58 mol/1 kg of silver, and was sensitized with a sulfur sensitizer and a gold sensitizer.

After 0.5 g of 5-methyl-6-oxy-1,3,4-triazaindolizine and 0.2 g of sodium 2-hydroxy-4,6-dichloro-s-triazine were added, the silver halide emulsions were coated on a cellulose triacetate film base in the amount of 70 ml/m² and then dried to provide photographic films.

These photographic films were exposed through a sensitometric step wedge to light of 1000 lux from a light source of 4800°K for 1/100 second and processed using the following reversal color processing steps.

| Step | Temperature | Time |
|---|---|---|
| 1. Pre-hardening | 37.8°C | 2 ½ min. |
| 2. Neutralizing | " | ½ " |
| 3. First Development | " | 3 " |
| 4. Stop | " | ½ " |
| 5. Wash | " | 1 " |
| 6. Color Development | " | 3 ½ " |
| 7. Stop | " | ½ " |
| 8. Wash | " | 1 " |
| 9. Bleach | " | 1 ½ " |
| 10. Fix | " | 1 ½ " |
| 11. Wash | " | 1 " |
| 12. Stabilizing | " | ½ " |

Each processing composition was as follows.

| | |
|---|---|
| **Pre-hardening Solution** | |
| Polyoxyethylene Sorbitan Monooleate (20 oxyethylene units) | 1 g |
| Glacial Acetic Acid | 2 ml |
| Succinic Aldehyde | 8.5 g |
| Sodium Sulfate (anhydrous) | 75 g |
| Magnesium Sulfate (heptahydrate) | 257 g |
| Sodium Bromide | 2 g |
| Sodium Acetate | 15 g |
| Formalin (37%) | 27 ml |
| 5-Nitrobenzimidazole | 0.04 g |
| Water to make | 1 liter (pH 4.80) |
| **Neutralizing Solution** | |
| Hydroxylamine Sulfate | 18 g |
| Sodium Bromide | 17 g |
| Glacial Acetic Acid | 10 ml |
| Sodium Hydroxide | 6.8 g |
| Sodium Sulfate (anhydrous) | 50 g |
| Water to make | 1 liter (pH 5.10) |
| **First Developer** | |
| Sodium Hexametaphosphate | 2 g |
| 1-Phenyl-3-pyrazolidone | 0.35 g |
| Sodium Sulfite (anhydrous) | 37 g |
| Hydroquinone | 5.5 g |
| Sodium Carbonate (anhydrous) | 28.2 g |
| Sodium Thiocyanate | 1.38 g |
| Sodium Bromide | 1.3 g |
| Potassium Iodide (0.1% aqueous solution) | 13 ml |
| Water to make | 1 liter (pH 9.90) |
| **Stopping Solution** | |
| Glacial Acetic Acid | 30 ml |
| Sodium Hydroxide | 1.65 g |
| Water to make | 1 liter |
| **Color Developer** | |
| Sodium Hexametaphosphate | 5 g |
| Benzyl Alcohol | 4.5 ml |
| Sodium Sulfite (anhydrous) | 7.5 g |
| Sodium Tertiary Phosphate (dodecahydrate) | 36 g |
| Sodium Bromide | 0.3 g |
| Potassium Iodide (0.1% solution) | 24 ml |
| Sodium Hydroxide | 3.25 g |
| Citrazinic Acid | 1.5 g |
| 4-Amino-3-methyl-N-(β-methanesulfonamidoethyl)-N-ethylaniline Sesquinsulfate | 11 g |
| Ethylenediamine (98%) | 3 g |
| Sodium Borohydride | 0.07 g |
| Water to make | 1 liter (pH 11.65) |
| **Bleaching Solution** | |
| Sodium Bromide | 35 g |
| Sodium Ferrocyanide(dodecahydrate) | 240 g |
| Potassium Persulfate | 67 g |
| Borax | 1 g |
| Polyethylene Glycol (50% aqueous solution) (Carbowax 1540, trade name produced by Union Carbide Chemicals Co., mol.wt. about 1540) | 6 ml |
| Sodium Hydroxide | 0.1 g |
| Water to make | 1 liter (pH 7.45) |
| **Fixing Solution** | |
| Sodium Thiosulfate (pentahydrate) | 200 g |
| Sodium Sulfite | 9 g |
| Water to make | 1 liter (pH 7.70) |
| **Stabilizing Solution** | |
| Formalin (37%) | 6 ml |
| Water to make | 1 liter |

After the processing, the optical density of the samples to blue light was measured and the minimum density in the highlight areas shown in Table 11 was obtained.

Table 11

| | Compound Additive Amount (g) | Compound Ratio to Coupler (wt.%) | Minimum Density |
|---|---|---|---|
| Control | 0 | 0 | 0.22 |
| Invention | 2 | 1 | 0.14 |
| " | 4 | 2 | 0.10 |

It is apparent from the results in Table 11 that the color fog of the 2-equivalent yellow dye-forming coupler (15) can be advantageously prevented by the compound (d) in black and white development prior to color development and hence beautiful reversal color image can be obtained with reduced color stain in the high-light areas.

While the invention has been described in detail and with reference to specific embodiments thereof, it will be apparent to one skilled in the art that various changes and modifications can be made therein without departing from the spirit and scope thereof.

What is claimed is:

1. A color photographic silver halide light-sensitive material comprising a support having coated thereon at least one hydrophilic colloid silver halide emulsion layer containing a non-diffusible alpha-acylacetoamide dye-forming coupler represented by the forumula (II):

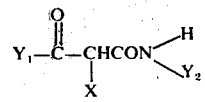

wherein $Y_1$ is an aliphatic group, an aromatic group or a heterocyclic group, $Y_2$ is an aromatic group or a heterocyclic group and X is a member selected from the group consisting of a fluorine atom, an acyloxy group, an aryloxy group, a heterocyclic oxy group, a cyclic acylamino group or a cyclic acysulfonylamino group, said emulsion layer or a hydrophillic colloid layer adjacent thereto containing a monoalkylhydroquinone represented by formula (I) or a compound capable of releasing said monoalkylhydroquinone by hydrolysis in aqueous alkaline solution:

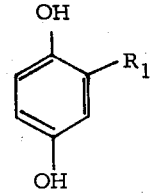

(I)

wherein $R_1$ is an alkyl group having at least 4 carbon atoms.

2. The photographic material as claimed in claim 1, wherein $Y_1$ is an alkyl group containing a tertiary carbon atom connected to the carbonyl group.

3. The photographic material as claimed in claim 2, wherein said alkyl group is a tert-butyl group.

4. The photographic material as claimed in claim 1, wherein $Y_1$ is a phenyl group or a halo-, amino-, acylamino-, sulfonamido-, ureido-, alkyl-, alkoxy- or aryloxy-substituted phenyl group.

5. The photographic material as claimed in claim 1, wherein $Y_2$ is a phenyl group or a halo-, trifluoromethyl-, amino-, acylamino-, sulfonamido-, ureido-, alkyl-, alkoxy-, aryloxy-, carboxy-, alkoxycarbonyl-, carbomoyl-, sulfo-, sulfamoyl or imide-substituted phenyl group.

6. The photographic material as claimed in claim 5, wherein the said yellow dye-forming coupler is represented by the formula (III):

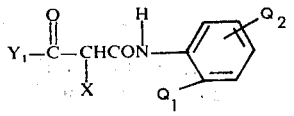

(III)

wherein $Q_1$ is a halogen atom, an alkoxy group, an aryloxy group, a dialkylamino group or an alkyl group, and $Q_2$ is attached to the 4- or the 5-position of anilide nucleus and is a halogen atom, a trifluoromethyl group, an acylamino group, a sulfonamide group, a ureido group, an alkyl group, an alkoxy group, an aryloxy group, a carboxy group, an alkoxycarbonyl group, a carbamoyl group, a sulfo group, a sulfamoyl group or an imide group.

7. The photographic material as claimed in claim 1, wherein $Y_1$ or $Y_2$ contains a hydrophobic group having not less then 8 carbon atoms.

8. The photographic material as claimed in claim 1, wherein $Y_1$ and $Y_2$ are free of a water-solublizing group, and contain a hydrophobic group having not less than 8 carbon atoms.

9. The photographic material as claimed in claim 1, wherein $R_1$ is a linear alkyl group having 4 to 18 carbon atoms.

10. The photographic material as claimed in claim 1, wherein $R_1$ is a branched chain alkyl group having 4 to 18 carbon atoms.

11. The color photographic material of claim 1, wherein said compound capable of releasing said monoalkylhydroquinone by hydrolysis in aqueous alkaline solution is a compound of the formula:

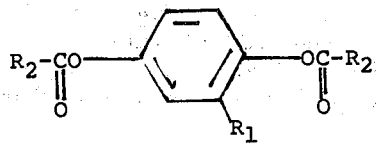

(Ia);

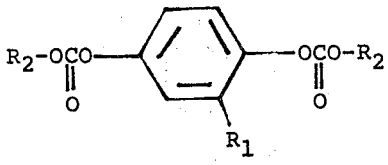

(Ib);

or

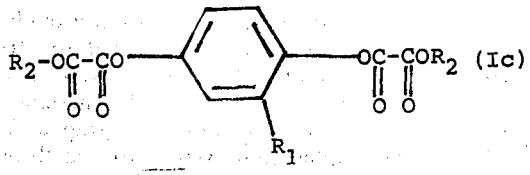

(Ic)

wherein $R_1$ is an alkyl group having at least 4 carbon atoms and $R_2$ is an alkyl group.

12. A color photographic silver halide light-sensitive material comprising a support having coated thereon a silver halide emulsion layer containing a non-diffusible alpha-acylacetoamide yellow dyeforming coupler represented by the formula (II):

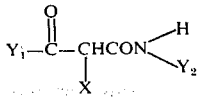

(II)

wherein $Y_1$ is an aliphatic group, an aromatic group or a heterocyclic group, $Y_2$ is an aromatic group or a heterocyclic group, and X is a member selected from the group consisting of a fluorine atom, an acyloxy group, an aryloxy group, a heterocyclic oxy group, a cyclic acylamino group or a cyclic acylsulfonylamino group, and a hydrophilic colloid layer containing tert-octylhydroquinone.

13. A color photographic silver halide light-sensitive material comprising a support having coated thereon a silver halide emulsion layer containing a non-diffusible alpha-acylacetoamide yellow dye forming coupler represented by the formula (II):

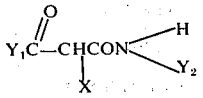

(II)

wherein $Y_1$ is an aliphatic group, an aliphatic group, an aromatic group or a heterocyclic group, $Y_2$ is an aromatic group or a heterocyclic group, and X is a member selected from the group consisting of a fluorine atom, an acyloxy group, an aryloxy group, an heterocyclic oxy group, a cyclic acylamino group or a cyclic acylsulfonylamino group, and containing a monoalkylhydroquinone represented by the formula (I) or a compound capable of releasing said monoalkylhydroquinone by hydrolysis in aqueous alkaline solution:

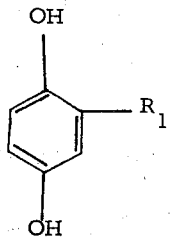

(I)

wherein $R_1$ is an alkyl group having at least 4 carbon atoms in said silver halide emulsion layer or a hydrophilic colloid layer.

14. A color photographic silver halide light-sensitive material comprising a support having coated thereon a silver halide emulsion layer containing a non-diffusible alpha-acylacetoamide yellow dye-forming coupler represented by the formula (II):

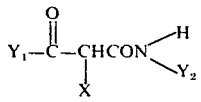

wherein $Y_1$ is an aliphatic group, an aromatic group or a heterocyclic group, and X is a member selected from the group consisting of a fluorine atom, an acyloxy group, an aryloxy group, a heterocyclic oxy group, a cyclic acylamino group or a cyclic acylsulfonylamino group, and a hydrophilic colloid layer containing a hydroquinone of which the benzene ring is substituted with one alkyl group having 4 to 10 carbon atoms, or a compound capable of releasing said monoalkylhydroquinone by hydrolysis in aqueous alkaline solution.

15. A color photographic silver halide light-sensitive material comprising a support having coated thereon a silver halide emulsion layer containing 0.2 to 5.0 millimol/$m^2$ of a non-diffusible alpha-acylacetoamide yellow dye-forming coupler represented by the formula (II):

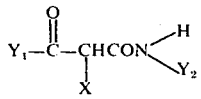

(II)

wherein $Y_1$ is an aliphatic group, an aromatic group or a heterocyclic group, $Y_2$ is an aromatic group or a heterocyclic group, and X is a coupling-off group, and containing 0.002 to 0.08 part by weight of a monoalkylhydroquinone represented by the formula (I) or a compound capable of releasing said monoalkylhydroquinone by hydrolysis in aqueous alkaline solution:

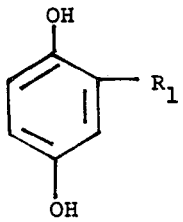

(I)

wherein $R_1$ is an alkyl group having at least 4 carbon atoms in said silver halide emulsion layer or a hydrophilic colloid layer per part by weight of the yellow dye-forming coupler.

16. A color photographic silver halide light-sensitive material containing a 2-equivalent alpha-acylacetoamide yellow dye-forming coupler of the formula (II):

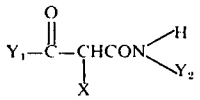

wherein $Y_1$ is an aliphatic group, an aromatic group or a heterocyclic group, $Y_2$ is an aromatic group or a heterocyclic group and X is a member selected from the group consisting of a fluorine atom, an acyloxy group, an aryloxy group, a heterocyclic oxy group, a cyclic acylamino group or a cyclic acylsulfonylamino group, and a monoalkylhydroquinone.

17. A color photographic silver halide light-sensitive material containing a 2-equivalent alpha-acylacetoamide yellow dye forming coupler of the formula (II):

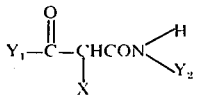

wherein $Y_1$ is an aliphatic group, an aromatic group or a heterocyclic group, $Y_2$ is an aromatic group or a heterocyclic group and X is a member selected from the group consisting of fluorine, an acyloxy group, an anyloxy group, a heterocyclicthio group, a heterocyclicoxy group, a heterocylicthio group, a cyclic diacylamino group and a cyclic acylsulfonylamino group, and a monoalkylhydroquinone represented by the formula (I) or a compound capable of releasing said monoalkylhydroquinone by hydrolysis in aqueous alkaline solution:

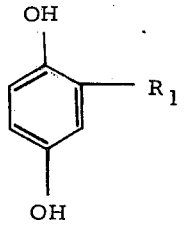

wherein $R_1$ is an alkyl group having at least 4 carbon atoms.

* * * * *